US005740620A

United States Patent [19]

Giese et al.

[11] Patent Number: 5,740,620

[45] Date of Patent: Apr. 21, 1998

[54] ELASTOMERIC CONNECTING MEANS FOR FOOTWEAR

[75] Inventors: Erik O. Giese; Mark C. Joseph; Roger J. Brown, all of Aspen; Michael D. Racosky, Boulder, all of Colo.

[73] Assignee: Comfort Products, Ltd., Aspen, Colo.

[21] Appl. No.: 678,900

[22] Filed: Jul. 12, 1996

Related U.S. Application Data

[63] Continuation-in-part of Ser. No. 270,853, Jul. 5, 1994, Pat. No. 5,611,155.

[51] Int. Cl.[6] ..... A43B 5/04; A43B 5/16

[52] U.S. Cl. ..... 36/118.2; 36/115

[58] Field of Search ..... 36/117.1, 117.2, 36/118.2, 118.3, 118.8, 118.9, 115

[56] References Cited

U.S. PATENT DOCUMENTS

| | | | |
|---|---|---|---|
| 1,546,551 | 7/1925 | Petri | 36/89 |
| 4,008,532 | 2/1977 | Kilbourn et al. | 36/120 |
| 4,095,356 | 6/1978 | Robran et al. | 36/121 |
| 4,107,856 | 8/1978 | Bourque | 36/115 |
| 4,126,323 | 11/1978 | Scherz | 280/11.12 |
| 4,268,981 | 5/1981 | Olivieri | 36/115 |
| 4,601,118 | 7/1986 | Zanatta | 36/120 |
| 4,655,465 | 4/1987 | Schaeffer | 280/11.12 |
| 4,777,742 | 10/1988 | Petrini et al. | 36/119 |
| 4,905,385 | 3/1990 | Perrissoud | 36/120 |
| 5,020,823 | 6/1991 | Bogner | 280/634 |
| 5,068,984 | 12/1991 | Kaufman et al. | 36/117 |
| 5,088,211 | 2/1992 | Walkhoff | 36/117 |
| 5,142,798 | 9/1992 | Kaufman et al. | 36/117 |
| 5,212,893 | 5/1993 | Pozzobon | 36/120 |
| 5,297,350 | 3/1994 | Stampacchia et al. | 36/120 |
| 5,397,141 | 3/1995 | Hoshizaki et al. | 280/11.3 |
| 5,437,466 | 8/1995 | Meibock et al. | 280/11.22 |
| 5,446,976 | 9/1995 | Donnadieu et al. | 36/117 |
| 5,452,907 | 9/1995 | Meibock et al. | 280/11.22 |
| 5,480,168 | 1/1996 | Chen | 280/11.22 |
| 5,498,033 | 3/1996 | Hoshizaki et al. | 280/841 |
| 5,499,461 | 3/1996 | Danezin et al. | 36/117 |
| 5,611,155 | 3/1997 | Brown et al. | 36/118.2 |

FOREIGN PATENT DOCUMENTS 1485766 12/1970 Germany .

*Primary Examiner*—B. Dayoan

*Attorney, Agent, or Firm*—Pennie & Edmonds, L.L.P.

[57] ABSTRACT

A boot having a shoe shaped shell member and a cuff member having a section overlapping the shell member. The cuff and shell members are pivotally connected together for pivoting movement in response to pivoting of the individual's leg relative to the individual's foot. An elastomeric material is disposed between said shell member to pivotally connect the two members together.

31 Claims, 22 Drawing Sheets

ELASTOMERIC CONNECTING MEANS FOR FOOTWEAR

This is a continuation-in-part application from patent application Ser. No. 08/270,853, filed on Jul. 5, 1994, now U.S. Pat. No. 5,611,155.

TECHNICAL FIELD

The invention relates to a means of attaching footwear parts together with an elastomeric material permitting relative movement between those parts to accommodate movements of the foot.

BACKGROUND OF THE INVENTION

Plastic footwear such as ski boots and boots for skates, collectively referred to herein as boots, are usually comprised of two, three or four parts necessary to permit flexing of the ankle forward and backwards while retaining lateral support for performance. These plastic parts are normally connected with metal rivets, permitting swiveling or rotation around the location of the rivets. Plastic is commonly used and the parts are formed by such methods as injection molding. The boot provides protection to the foot and lower leg and adds sufficient stiffness to permit good performance such as in skates and in ski boots where lateral support is necessary for various maneuvers.

It is necessary when skiing or skating to permit the skier or skater to bend his or her knees in the forward direction and to encounter various resistance as the knee is bent further forward, eventually coming to a stop, before damage occurs to the Achilles tendon. This requires fairly precise fit of the plastic pieces and careful placement of rivets or other pivoting means to provide for comfort and performance at the same time.

Normally a boot of the above described type has a lower shell having a heel, middle and front section for receiving and supporting an individual's foot along the heel, bottom, sides and top front portion of the foot. The boot may also include a cuff which covers the upper portion of the foot or lower leg. The cuff is the part which rotates forward when the knee is bent. Additionally, many boots have tongues or rear portions which permit exit and entry in the case of front-entry or rear-entry boots.

Conventionally constructed boots utilizing rivets are limited in that the cuff or other plastic parts attached to the lower shell must rotate around a fixed point. This is not necessarily compatible with the human foot, which has a semi-sliding joint in the ankle rather than one which pivots from a point between the ankle bones.

SUMMARY OF THE INVENTION

It is, therefore, an object of the invention to provide a boot construction which will allow the plastic parts to slide back and forth, in addition to rotation, in order to accommodate the anatomical characteristics of the ankle joint and movement of the lower leg.

It is a further object to provide for various forward and rear flex resistance by releasably connecting the plastic parts together through the use of interchangeable elastomeric materials.

It is also an object of the invention to permit the use of low cost plastics for the shell and cuff parts and to reduce the criticality of the flex characteristics of the plastic.

It is still a further object of the invention to provide for a boot construction which is shock absorbing in various directions, as well as to provide a spring-back effect tending to return the foot to the normal position with respect to a ski or skate boot when bending forces are removed.

It is still a further object of the invention to provide for a boot construction to eliminate significant bow or bulge effect occurring in various parts of the boot when the wearer's leg is bent forward, thus aiding lateral support and providing a comfortable fit.

Generally, a boot constructed according to the invention comprises a relatively stiff outer shell covering the lower part of the foot, and an upper portion or cuff surrounding the upper part of the foot or lower leg of the wearer. A soft inner boot is positioned in the shell and is adapted to engage the foot of the wearer. The cuff and shell, or other plastic parts are connected to each other with an elastomeric material which is fastened to the various plastic parts. The elastomeric material permits relative movement between the plastic parts due to the shear quality of the material, in addition to stretching or compressing of the elastomeric material in all directions. The flexing of the boot incorporating the elastomeric material provides a degree of spring-back tending to return the foot and leg to the normal unbent position when bending forces are removed. Most importantly, the natural flex characteristics of the ankle are enhanced by particular placement of the elastomeric connecting material to the plastic parts surrounding the foot and lower leg.

In one embodiment of the invention the boot has two cuff insert units, one on either side of the foot. Each cuff insert unit includes a cuff member insert and elastomeric material extending therefrom. The elastomeric material is in the form of two round discs, which are bonded to the two cuff member inserts. The cuff member inserts are connected to the lower cuff and the cuff insert units connect the lower cuff to the upper shell. The material may be bonded to the cuff insert units and may contain snap-fit protruding pieces which will fit into corresponding recesses or apertures in the respective plastic parts. A fastening means is used to attach the elastomeric material to the lower shell.

In a further embodiment of the invention, the elastomeric material may connect plastic parts in both front-entry and rear-entry boots by proper placement of the connecting parts of the lower shell, cuff and other plastic parts comprising the boot. Interchangeability of the cuff insert unit and the elastomeric connecting material is also possible, thus permitting the wearer to change the flex characteristics of the boot by simply exchanging the cuff insert unit, with one having a harder or softer piece of elastomeric material. For example, a stronger skier or skater may prefer a stiffer insert while a weaker skier or skater may prefer a softer insert. The elastomeric material also provides a smooth power transfer during the stride and helps to energize the stride and also provides a vibration dampening feature, which reduces fatigue in the skier or skater.

DETAILED DESCRIPTION OF THE INVENTION

Figure 1:
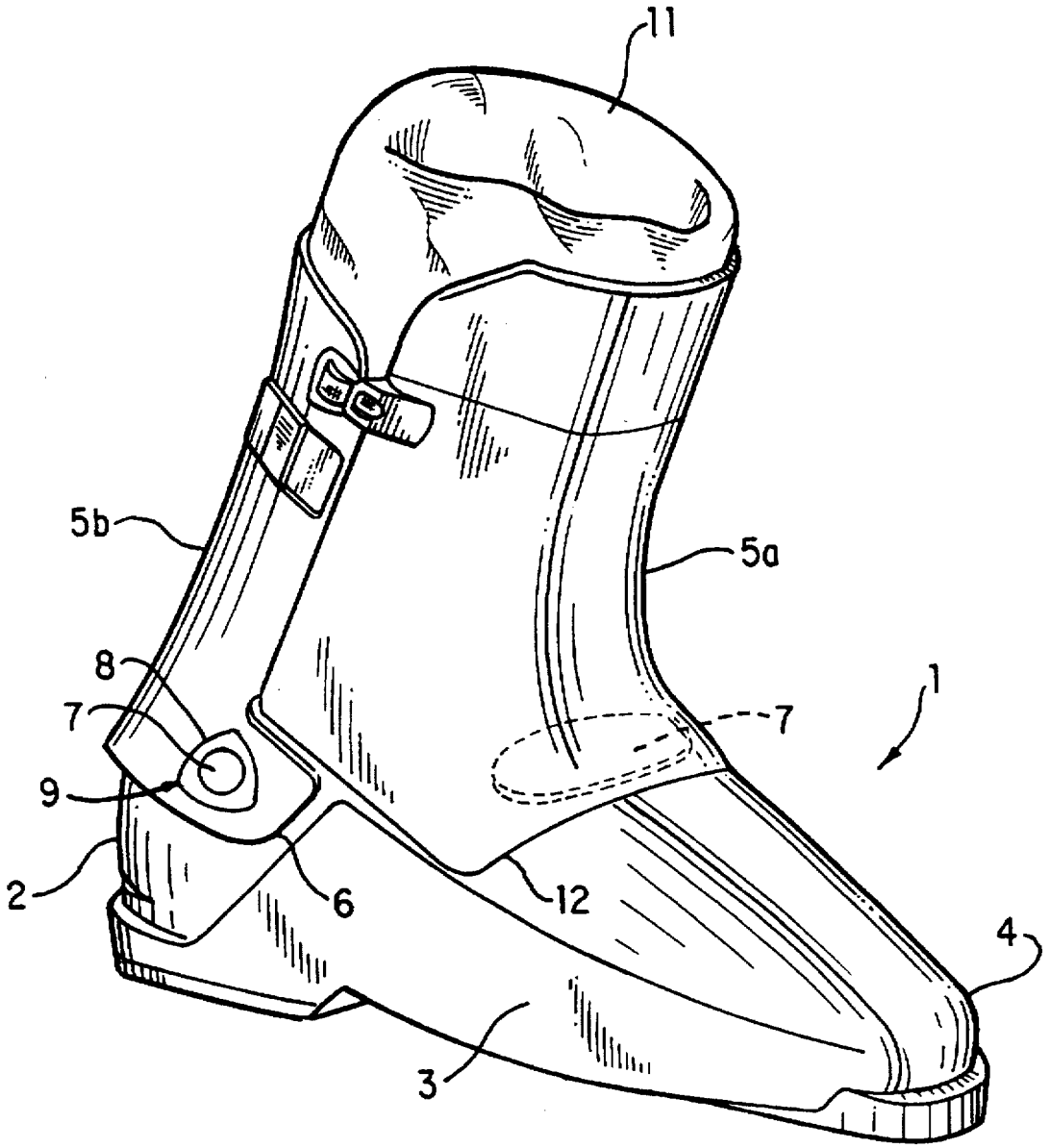
FIG. 1 is a perspective view of one embodiment of the invention.

FIG. 1 shows an embodiment of the invention as incorporated into a ski boot. The boot includes a shell member 1 having a heel portion 2, a middle portion 3, and a front portion 4 for receiving and supporting an individual's foot along at least the bottom, sides, and front top portions of the foot. The boot further includes a front cuff member 5*a* and a back cuff member 5*b* having overlapping sides sections 6 only one of which is shown in the drawings. The overlapping sections 6 extend on either side of the shell member 1 in the area of the ankle bone of the individual's foot with a first surface of the overlapping sections 6 facing a first surface of the shell member 1. The cuff members extend upwardly from the shell member for covering a portion of the individual's leg and are pivotally connected to the shell member for pivoting movement in response to the pivoting of the individual's leg relative to the individual's foot. The pivoting of the cuff members 5*a* and 5*b* to the shell 1 is, in accordance with the teachings of the present invention, effected by attaching means in the form of elastomeric material 7. Also, the back cuff member 5*b* is pivoted to the heel portion 2 of the shell by the elastomeric material 7. Finally, disposed internally of the shell and cuff structure of the boot is an inner boot 11.

The overlapping sections 6 of the cuff member 5*b* each have a cuff member insert 8. The cuff member insert 8 has a first surface facing the first surface of the shell member. The elastomeric material 7 is bonded to and extends inwardly from the cuff member insert 8 to the first surface of the shell member. The elastomeric material 7 together with the cuff member insert 8 comprise a cuff insert unit 9. Each cuff insert unit 9 is removably connected to the cuff member 5 at the area of pivotal connection in relation to the shell member 1.

The following embodiments show the cuff insert unit 9 attached to the cuff member 5 with the cuff insert unit 9 extending and connecting to the shell member 1. Nevertheless, the attachment could be reversed with the cuff insert unit 9 attached to the shell 1 with the cuff insert unit 9 extending and connecting to the cuff member 1.

In the embodiment of the invention shown in FIG. 1, the elastomeric material is disposed in the overlapping side sections of the cuff member and also in the overlapping front section 12 of the cuff member which extends toward the front portion 4 of the shell 1. Although not shown in FIG. 1, there would be an elastomeric material on the hidden side of the cuff member where it overlaps with the shell of the boot.

Figure 2:
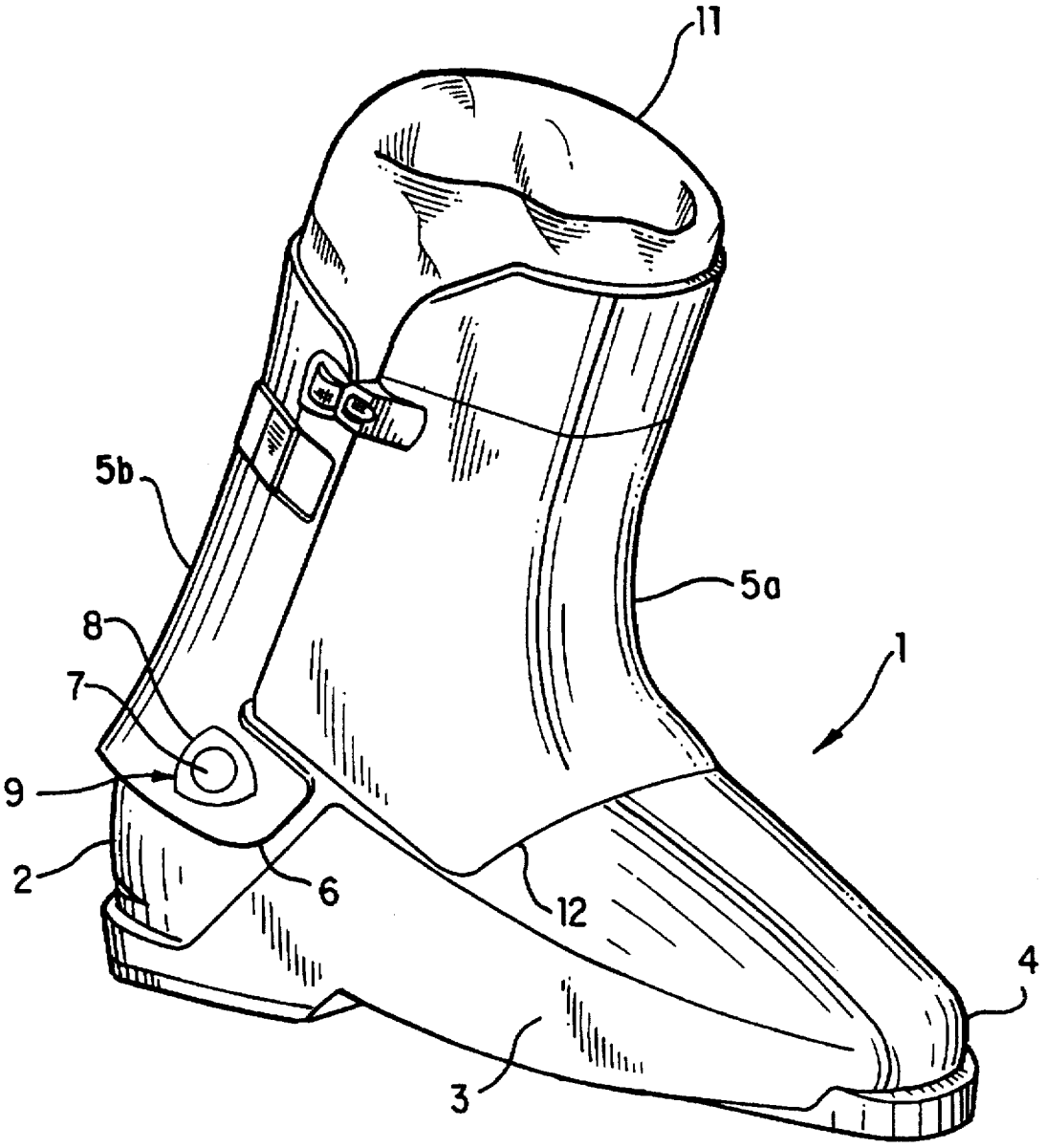
FIG. 2 is a perspective view of another embodiment of the invention similar to that of FIG. 1.

The boot construction shown in FIG. 1 includes three elastomeric materials for connecting the cuff member to the shell member. However the middle elastomeric material at the forward section of the cuff can be eliminated, leaving elastomeric material only in the side overlapping sections of the cuff and shell member. Such a construction is shown in FIG. 2. Alternatively, the overlapping side sections of the cuff and shell members can be connected by conventional rivets and the elastomeric material disposed only at the forward section of a cuff member.

The elastomeric material used to connect the shell and cuff members together has opposite first and second sides with the first side facing and attaching to the first surface of the shell member and the second side facing and attaching to the inner surface of the cuff member. The thickness of the material as measured between the first and second sides is a fraction of the distance laterally across either of the sides.

In accordance with the teachings of the present invention, the elastomeric material includes physical characteristics permitting the first and second sides to rotate and shift laterally with respect to each other during pivoting of the cuff member on the shell member. In this way, the elastomeric material defines a floating pivot for the pivoting of the cuff member. In the broader sense, the elastomeric material is a rubber-like material having broad performance characteristics over a wide temperature range. As for example from minus 20° to 110° F.

Materials that will perform under these conditions will be, for example, but not limited to, polyether polyurethanes, polyester polyurethanes, rubbers, thermoplastic urethanes, thermoplastic elastomers, any copolymer of these or other materials, and any other such elastomeric material that can be cast, compression molded, injection molded, extruded or any other type of manufacturing process. The materials may also use a form of reinforcing such as, but not limited to, fibers, cloths, or fillers.

The elastomeric materials used may or may not require crosslinking to perform over the required temperature range while maintaining the required physical properties.

The chemicals that are selected for the elastomeric material need to have both physical and dynamic characteristics to perform adequately. The physical properties define the material "toughness". The rebound, ultimate elongation, and compression set all contribute to the "flex" characteristic of the boot. As these particular properties vary, the performance of the boot will change. The ultimate tensile and split/tear is required to minimize a material failure over the temperature range of operation.

The preferred elastomeric material and the related physical properties for a ski boot were disclosed in patent application Ser. No. 08/270,853 filed on Jul. 5, 1994, now U.S. Pat. No. 5,611,155, which is incorporated herein by reference. The elastomeric material disclosed in the earlier disclosure could also be used for an in-line skate boot.

A polyester polyurethane, specifically, PELLATHANE from Dow Chemical, is presently the preferred elastomeric material for its ease of manufacturing and its physical and dynamic characteristics. Polyether urethanes, copolymers and other materials that exhibit similar characteristics may also be used with similar results.

The components of the polyester polyurethane used for an in-line skate boot application have the following physical properties.

| | Ranges | Preferred Embodiment |
|---|---|---|
| Durometer | 50–90 Shore A | 77 Shore A |
| Bayshore Rebound | 30–85% | 75% |
| Split Tear | 15–200 psi | 45 psi |
| 100% Modulus | 50–1000 psi | 192 psi |
| 300% Modulus | 100–3000 psi | 224 psi |
| 500% Modulus | 150–5000 psi | 256 psi |
| Ultimate Tensile | 1000–5500 psi | 1280 psi |
| Ultimate Elongation | 200–800% | 750% |
| Compression Set | 1–50% | 30% |

The elastomeric material 7 and the cuff member insert 8 may be manufactured by using either an injection molded process or a cast process. The injection molded process is the preferred process because it is more cost effective when manufacturing in large volumes versus the cast process.

In the preferred injection molded process, the cuff member insert 8 comprises a fiberglass filled (15–30%) injection moldable polyurethane in the 30 to 80 shore D durometer range and is injection moldable TPU (Thermo PU). Specifically, ESTALOCK from BF Goodrich is the preferred material for the cuff member insert 8. In the preferred injection molded process, the elastomeric material 7 comprises an ester based polyurethane in the 50 to 90 shore A durometer range and is injection moldable TPU (Thermo PU).

The injection molded process uses materials for the cuff member insert 8 and the elastomeric material 7 that are supplied in pellet form and that are heated and melted in a high pressure injection mold. The cuff member insert 8 is injection molded and cooled in a first mold. Then, the cuff member insert 8 is inserted into a second mold and is heated to approximately 200° F. The polyurethane elastomer is then heated to approximately 300° F. and then injected around and through the cuff member insert 8. The heated polyurethane elastomer forms a chemical bond to the heated cuff member insert 8. In addition, a mechanical connection is created by the polyurethane elastomer flowing through cuff member insert flow holes 48 (See FIG. 8) and forming around the cuff member insert 8.

If the cast process is used, the cuff member insert 8 is made from an ether based two part liquid polyurethane in the 60 shore D durometer range with a 15% fiberglass fill. In the cast process, the elastomeric material 7 is an ether based two part liquid polyurethane in the 60 to 80 shore A durometer range.

The cast process uses liquid materials that are two part solutions, which are mixed and poured into a mold and set or hardened by a chemical reaction between the two liquids.

In the cast process, the cuff member insert 8 is mixed and poured into a cast mold. The part is removed after setting or hardening and is heated and placed into a second mold where the softer elastomeric material 7 is mixed and poured into the second mold. The poured liquid elastomeric material forms a chemical bond to the previously hardened cuff member insert 8. In addition, a mechanical connection is created by the polyurethane flowing through the cuff member insert flow holes 48 (See FIG. 8) and forming around the cuff member insert 8.

Another material that could be used for the elastomeric material is an isocyanate terminated urethane prepolymer. The prepolymer (also referred to as the A-side) composition is diphenylmethane di isocyanate (MDI) and a high molecular weight polytetramethylene ether glycol (PTMEG). The B-side composition is a high molecular weight polytetramethylene ether glycol (PTMEG) mixed with a tri-functional curative.

The PTMEG in the formulation provides the soft resilient segment that directly effects the physical and dynamic properties. The tri-functional curative assists in the split/tear and the dynamic performance.

The mix ratio of the A and B side materials in the preferred embodiment is 0.42 grams A-side to 1.000 grams B-side. Depending upon the desired material characteristics, the formulation and subsequent mix ratio will vary.

In accordance with the invention, the connection of the first and second sides of the elastomeric material to the shell and cuff members respectively is effected so that the first and second sides of the material can move relative to each other in a direction extending along the surfaces of the shell and cuff members to which the material is connected.

In FIGS. 5, 7–8, 10–13, 19 and 21–31, the elastomeric material is shown, wherein the first side of the elastomeric material facing the first surface of the shell member 1 is designated by reference number 13 and the second side of the elastomeric material facing the first surface of the cuff insert unit is designated by reference number 14.

Due to the physical characteristics of the elastomeric material, the cuff member of the boot can now pivot on the shell member upon a floating pivot axis. In other words, the opposite first and second sides of the elastomeric material can shift laterally and rotate simultaneously with respect to each other during pivoting of the cuff member. Such movement of the elastomeric material is shown, for example, in FIG. 12.

Figure 3:
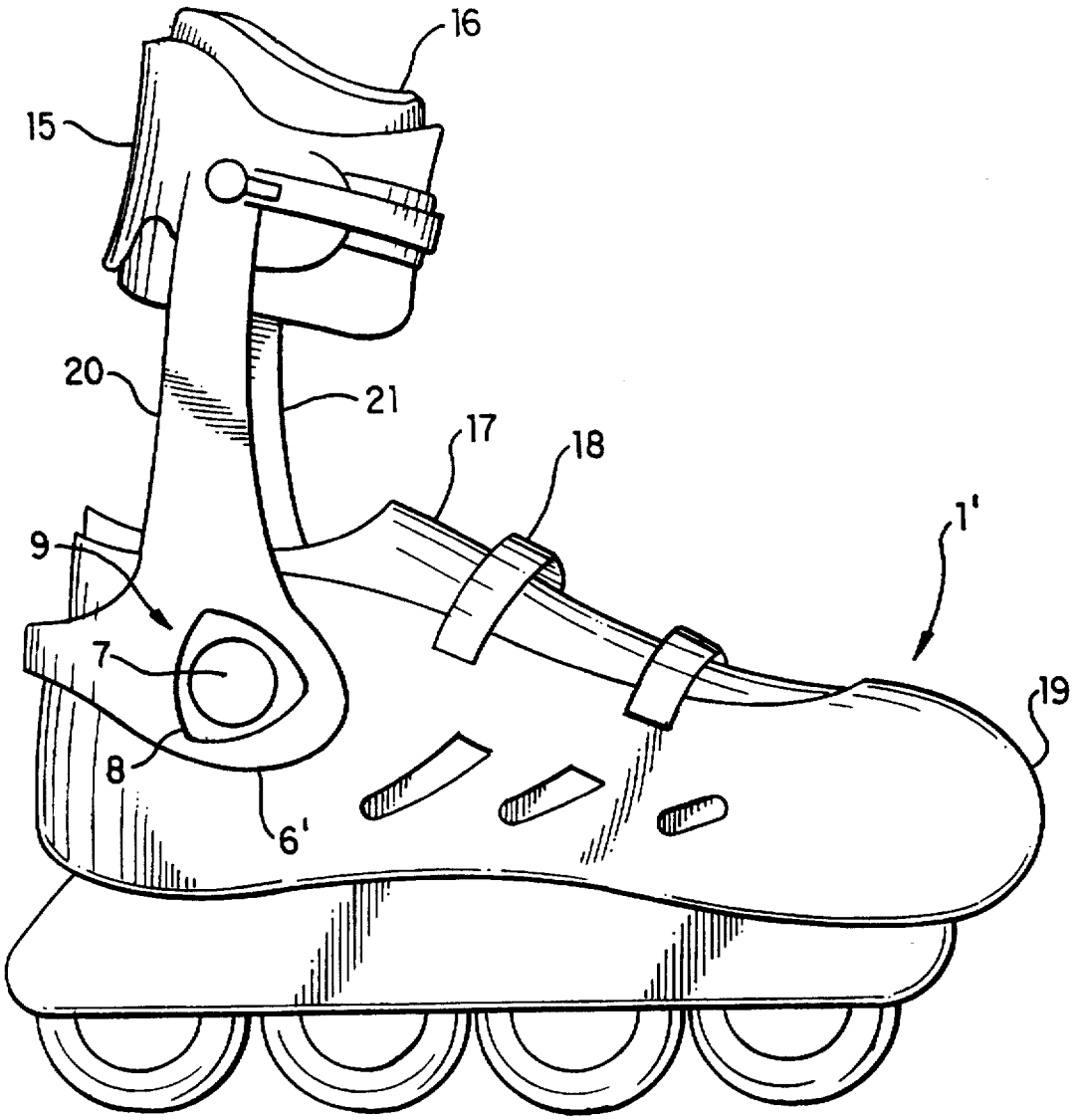
FIG. 3 is a perspective view of another embodiment of the invention employing exoskeletal cuff and shell members.
Figure 4:
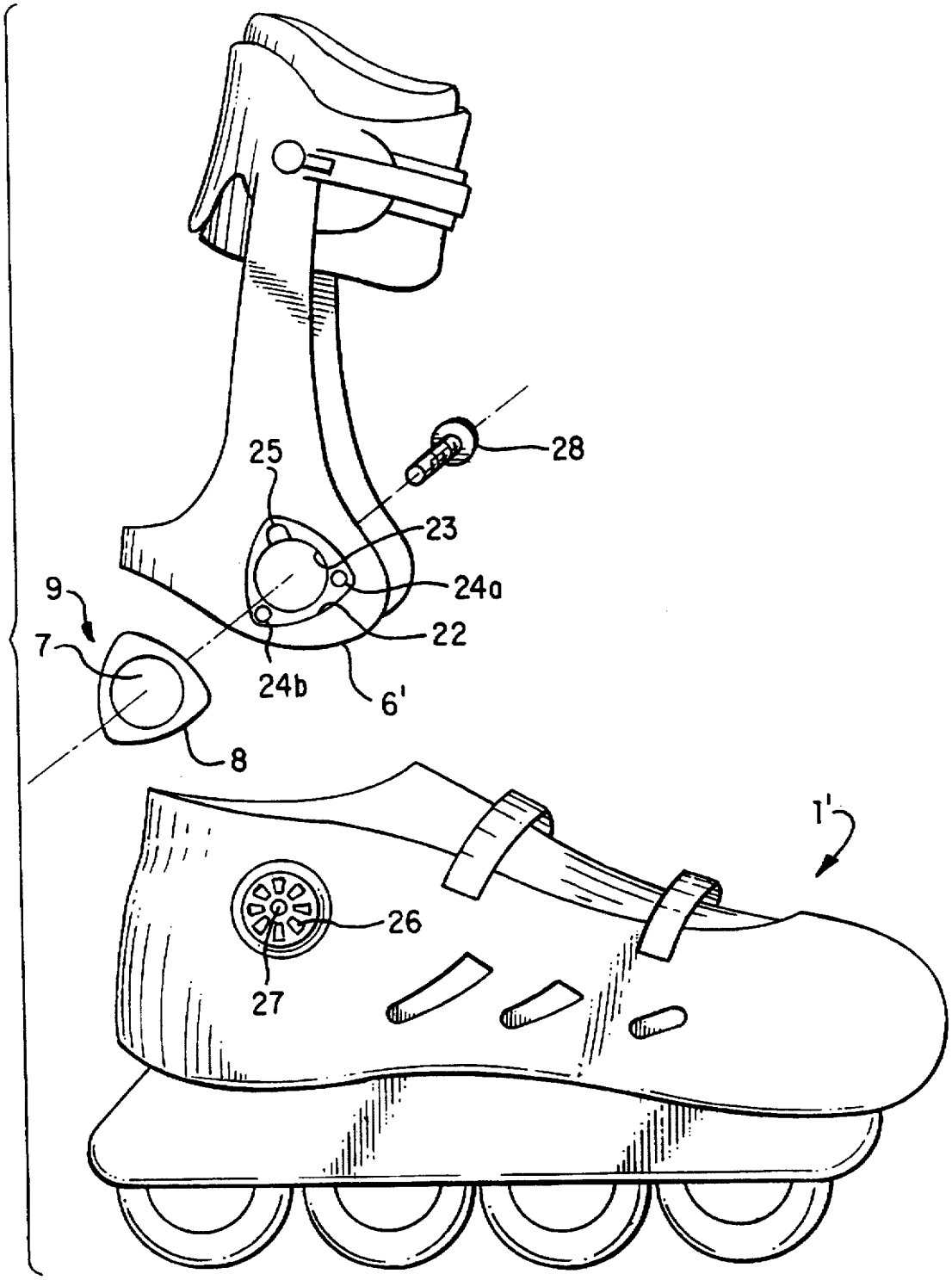
FIG. 4 is an exploded view of the embodiment of FIG. 3 showing the cuff member and the cuff insert unit in relation to the shell member of the boot.
Figure 5:
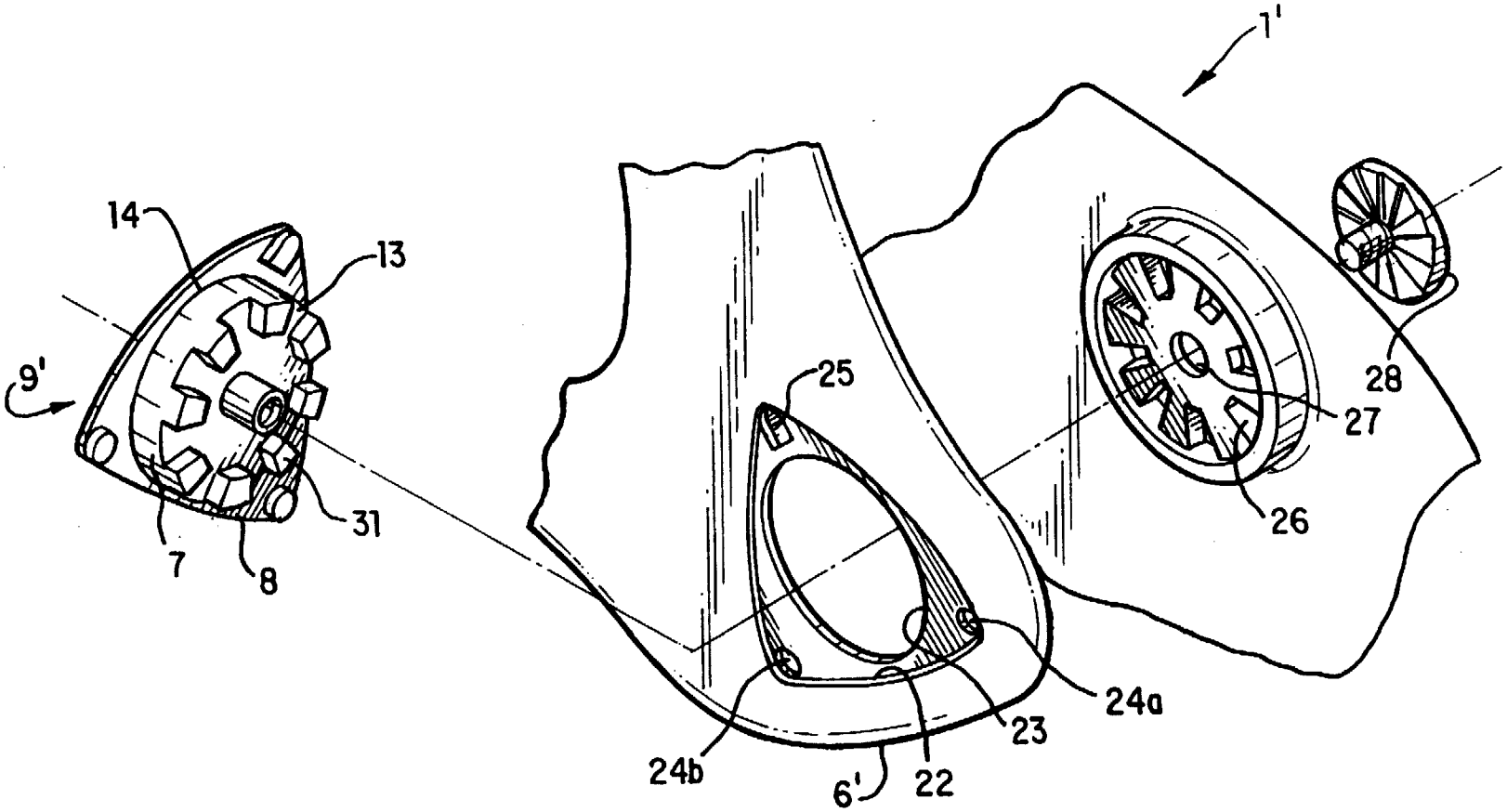
FIG. 5 is an exploded close-up view of the embodiment of FIG. 3 showing the cuff member, cuff insert unit, and shell member.

FIGS. 3–5 show an embodiment of the invention as incorporated into an in-line roller skate with exoskeletal cuff and shell members.

The in-line roller skate shown in FIGS. 3–5 has an open configuration, wherein an exoskeletal cuff member 15 is connected to an exoskeletal shell member 1' by elastomeric material 7, which is bonded to the cuff member insert 8. The cuff member 15 is padded internally with cuff padding 16 to cushion the lower leg against the cuff member 15. A shell bootie 17 is located internal of the shell 1' and is secured to the shell 1' with a plurality of closure straps 18. The closure straps 18 extend across the top of the shell member 1' for holding the individual's foot and the shell bootie 17 within the shell member 1'. The shell member 1' further has a toe guard 19 to protect the individual's toes from contact with the pavement.

The cuff member 15 has a first cuff beam 20 and an opposite second cuff beam 21, each cuff beam extends to the shell 1' from the cuff member 15 and each has an overlapping side section 6'. Each overlapping side section 6' houses a cuff insert unit 9, which comprises the cuff member insert 8 and the elastomeric material 7 extending therefrom. The cuff insert unit 9 is removably connected to the cuff overlapping side section 6' and pivotally connects the cuff overlapping side sections 6' to the shell member 1'.

As shown in exploded views of FIGS. 4 and 5, the cuff overlapping side sections 6' each have a cuff insert recess 22 at the exterior or second surface opposite of the first or inner surface of the cuff member. The cuff insert recess 22 is complementary to the cuff member insert 8 outer peripheral surface. The cuff overlapping side sections 6' also each have a cuff opening 23 so that the elastomeric material 7 may pass through the cuff opening 23 when assembled and connect the cuff overlapping side sections 6' to the shell member 1'. The overlapping side sections 6' also have two post recesses 24*a* and 24*b* and a larger keyed post recess 25. The shell 1' has a plurality of radially spaced apart lug recesses 26 and a shell aperture 27 for accepting a bolt means, connector, stud, or fastener. The connector is shown as a bolt 28 with a bolt axis extending between the first end and the second end of the bolt. The bolt would mate with a complementary fastener in the cuff insert unit 9. The fastening method will be described in more detail below. The connector restricts axial movement of the elastomeric material relative to the cuff member and the shell member.

Figure 6:
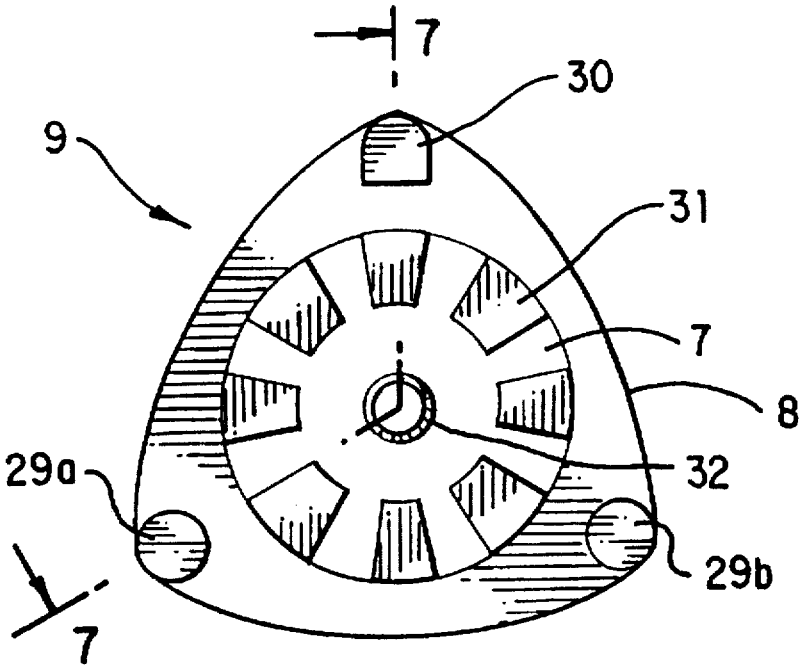
FIG. 6 is a plan view of an embodiment of the cuff insert unit with the elastomeric material attached.
Figure 7:
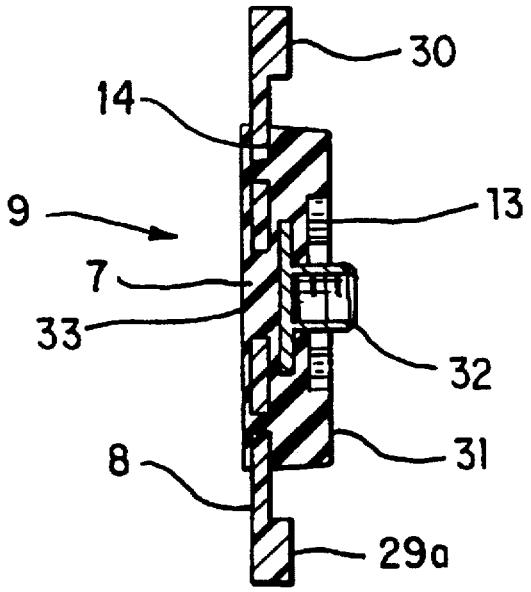
FIG. 7 is a cross-sectional view taken from line 7—7 from FIG. 6.
Figure 8:
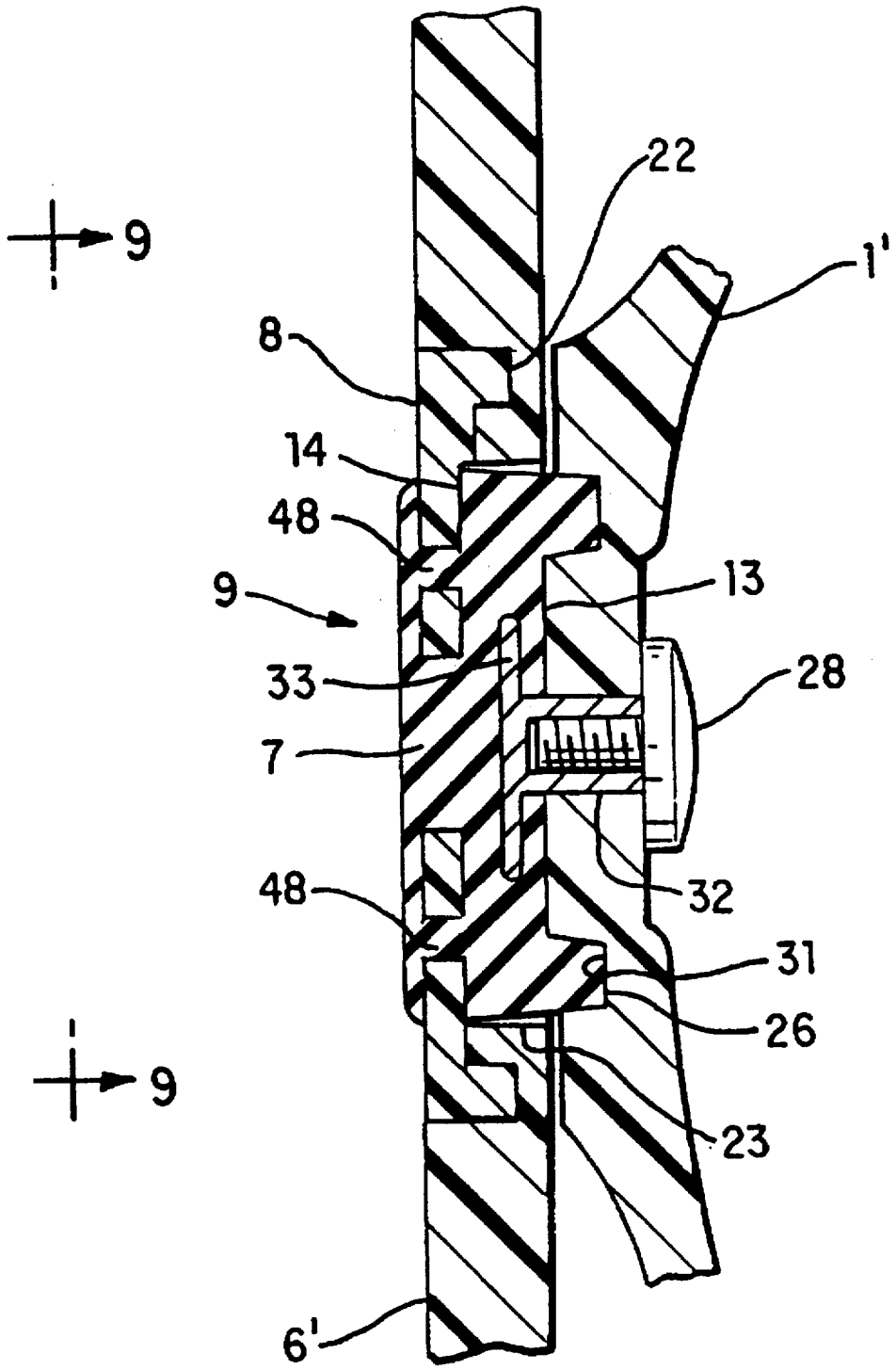
FIG. 8 is a cross-sectional view showing one way to attach the cuff insert unit to the respective parts of the boot.

One of the embodiments of the cuff insert unit 9 of the present invention is shown in FIGS. 6 and 7. This embodiment of the cuff insert unit 9 would be used in the boot assembly shown in FIG. 4, wherein the bolt 28 (shown in FIG. 4) mates with the cuff insert unit 9. The cuff insert unit 9 comprises the cuff member insert 8 with the elastomeric material 7 extending therefrom. The elastomeric material 7 at the second side 14 is bonded to the cuff member insert 8. The cuff member insert 8 has two anti-rotation posts 29*a* and 29*b* and a larger anti-rotation keyed post 30. The posts 29*a*, 29*b*, and 30 are complementary to the cuff post recesses 24*a*, 24*b*, and 25, respectively, with the keyed post 30 interconnecting with the cuff keyed post recess 25. As shown in FIGS. 5 and 8, the elastomeric material 7 has a plurality of lugs 31 extending from the cuff member insert 8 to interconnect with the shell lug recesses 26 and to connect the cuff overlapping side sections 6' to the shell member 1'. The lugs 31 and the shell lug recesses 26 prevent rotation of the elastomeric material first side 13 relative to the shell member 1'. The cuff insert unit 9 also has a connector, or a fastening means 32, which is complementary to the fastener 28. The fastening means 32 is a T-nut embedded into the elastomeric material 7. When the boot is assembled, the cuff opening 23 is aligned with the lug recesses 26, with the cuff insert unit 9 fitting into the cuff insert recess 22. The elastomeric lugs 31 fit into the lug recesses 26 and the fastening means 28 and 32 hold side 13 against the shell 1' to provide a floating pivot axis in relation to the cuff overlapping sections 6' and the shell member 1'.

The cuff member insert 8 has a triangular or wankel configuration and combines with the posts 29*a*, 29*b*, and 30 and the post recesses 24*a*, 24*b*, and 25 to prevent relative rotation between the cuff member insert 8 and the cuff overlapping sections 6' about a pivot axis. The keying feature with the keyed post recess 25 and the keyed post 30 allows certain positioning of the cuff insert unit 9 in relation to the cuff overlapping sections 6' and allows the positioning of the manufacturer's logo on the external side of the cuff insert unit 9.

Figure 9:
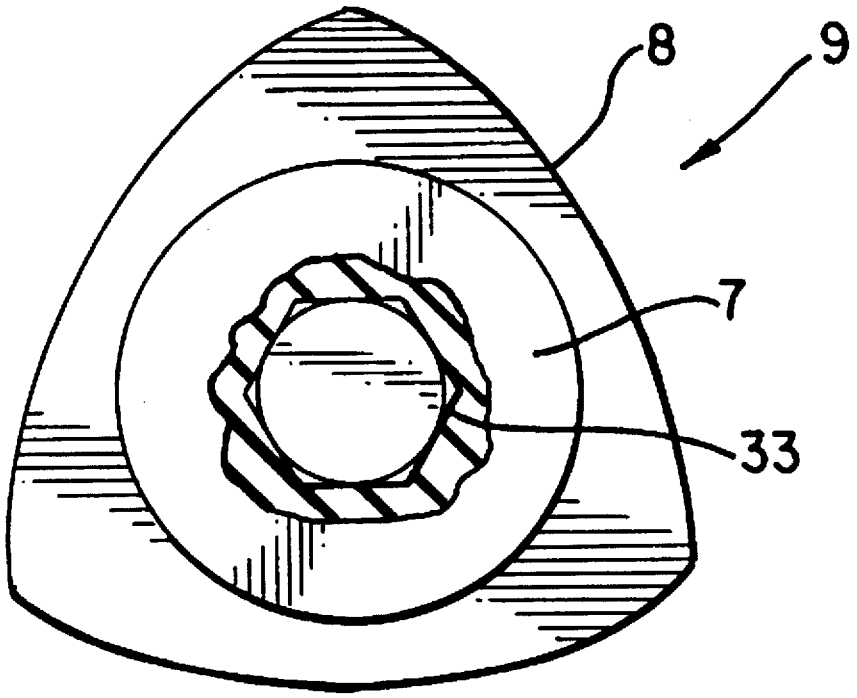
FIG. 9 partial cross-sectional view of the cuff insert unit taken from line 9—9 from FIG. 8.

FIG. 8 is a cross sectional view of the cuff insert unit 9 of FIG. 6, showing the cuff insert unit 9 assembled to the boot. The T-nut 32 has a flange 33 that is embedded in the elastomeric material 7. As shown in FIG. 9, the flange 33 has a hexagonal or octagonal shape to provide an anti-rotation feature between the T-nut 32 an the elastomeric material 7.

To provide proper adhesion between the cuff member insert 8 and the elastomer 7, the cuff member insert 8 has a plurality of flow holes 48 to allow the elastomer 7 to flow through and bond to the cuff member insert 8 during the manufacturing process, as described above.

Figure 10:
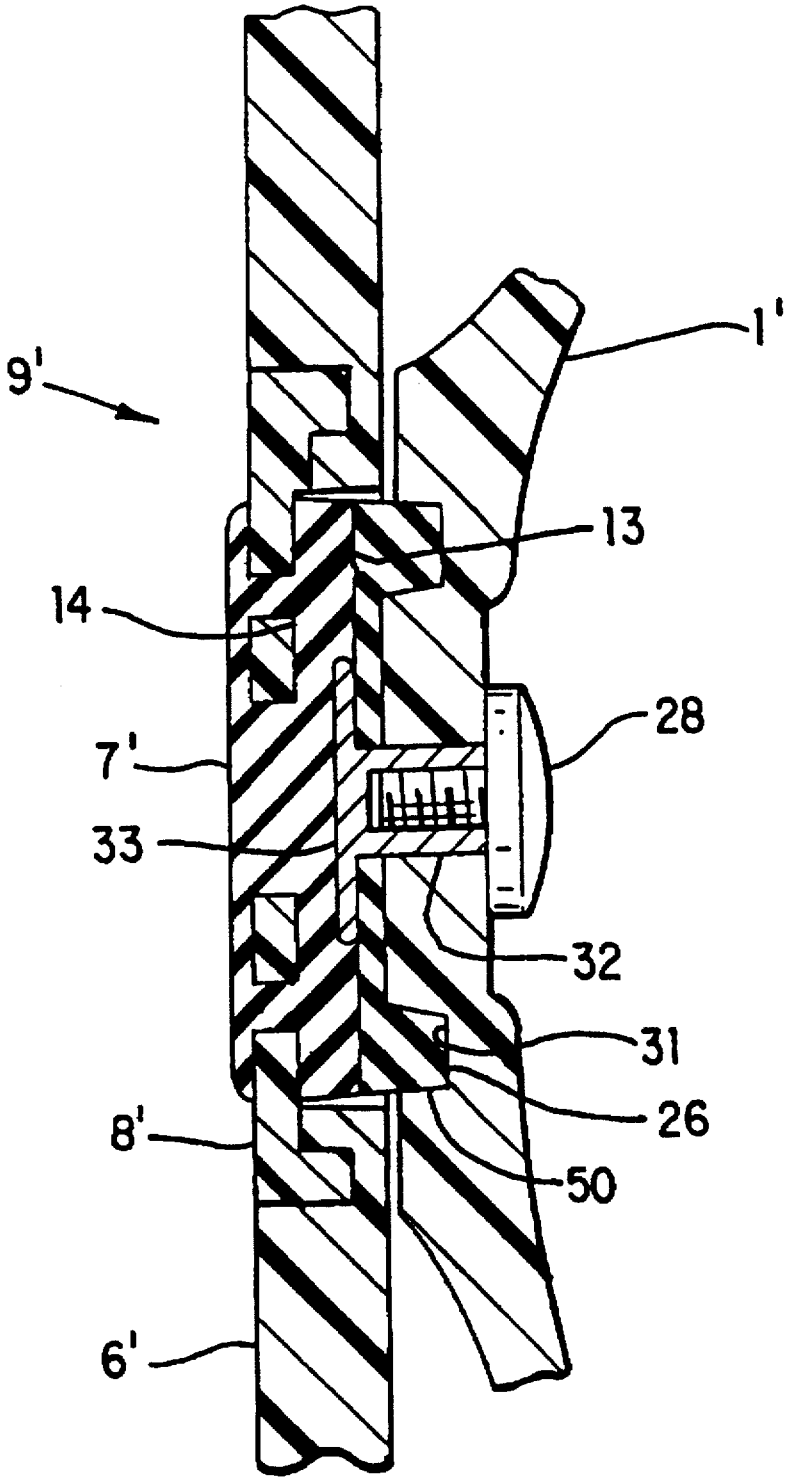
FIGS. 10–13 are partial cross-sectional views showing different ways of attaching the cuff insert unit to the respective parts of the boot.

Another embodiment of the cuff insert unit 9' is shown in FIG. 10, this embodiment is similar to the embodiment shown in FIG. 8, except that the cuff insert unit 9' has a lug plate 50 bonded to the first side 13 of the elastomeric material. The T-nut 32 is embedded in the elastomeric material 7 and the flange 33 is adjacent to the first side of the elastomeric material 13. The lug plate 50 comprises the same material as the cuff member insert 8. The lug plate 50 is preferably injected molded, but may be cast molded to the elastomeric material 7 after the elastomeric material 7 has been injected molded or cast molded to the cuff member insert 8 and has hardened and cooled.

Figure 11:
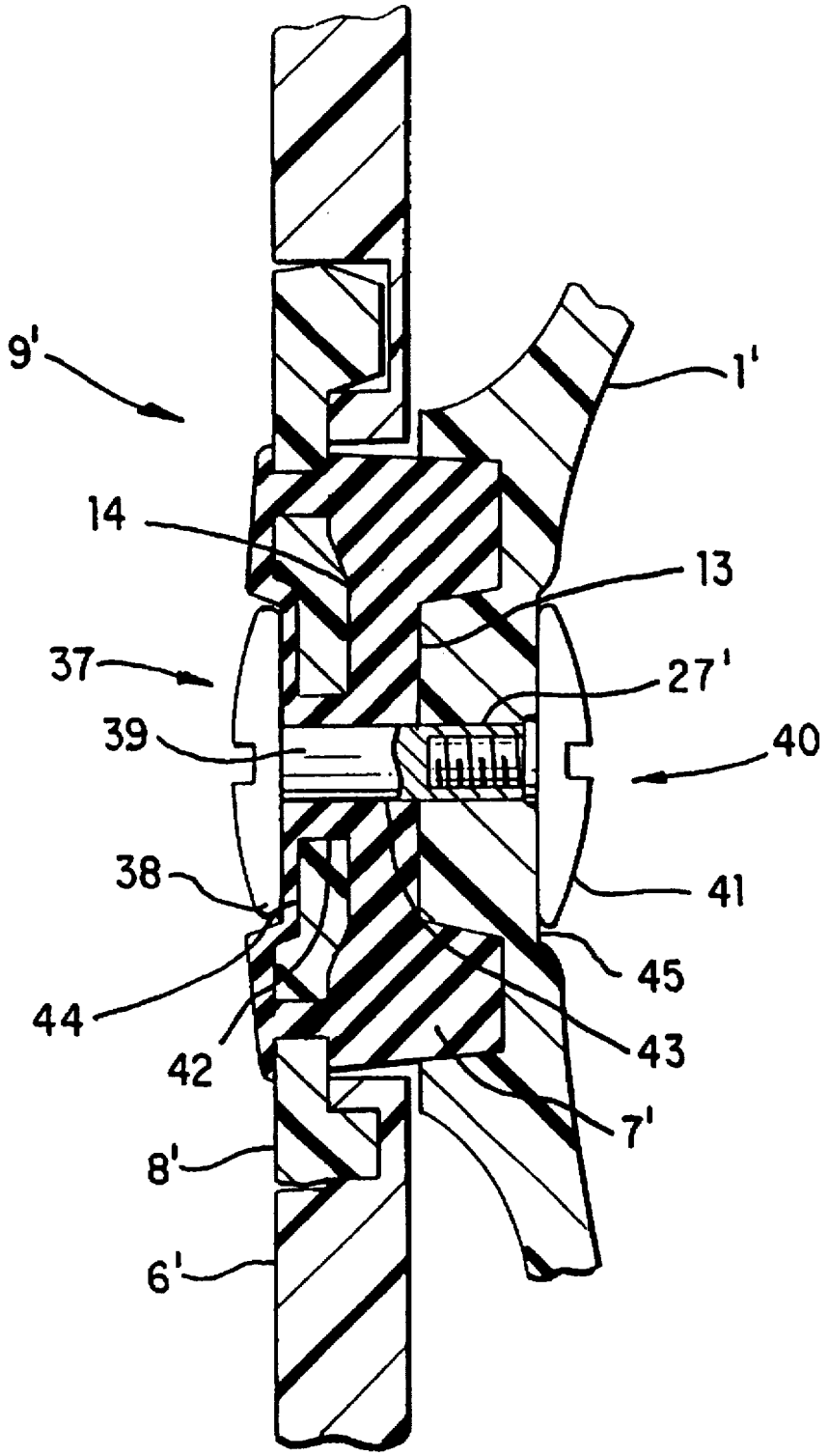

FIG. 11 shows another embodiment of the cuff insert unit 9' of the present invention, which is similar to the embodiment shown in FIG. 8, except that the cuff insert unit 9' has a connector, or a first fastener 37 with a flange 38 and a stud portion 39 and a complementary second fastener 40 with a flange 41. The cuff member insert 8' has a cuff aperture 42, the shell member 1' has a shell aperture 27' and the elastomeric material 7' has an aperture 43. The apertures 42, 27' and 43 are axially aligned relative to each other and allow the passage of the first fastener stud portion 39 through the cuff insert unit 9'. The cuff aperture 42 or the shell aperture 27' are larger than the stud portion 39 to define a stud clearance gap. The cuff aperture 42 is shown larger in FIG. 11. The cuff insert 8' has a flange recess 44 at the cuff insert unit second side to accommodate the seating of the first fastener flange 38; likewise, the shell 1' has a shell flange recess 45 to accommodate the seating of the second fastener flange 41. A layer of elastomeric material 7' approximately 0.050–0.100 inches thick covers the flange recess 44 and the cuff aperture 42. The first fastener 37 and the second fastener 40, or connector, combine with the elastomeric material 7' to provide a floating pivot within the cuff insert unit 9'.

Figure 12:
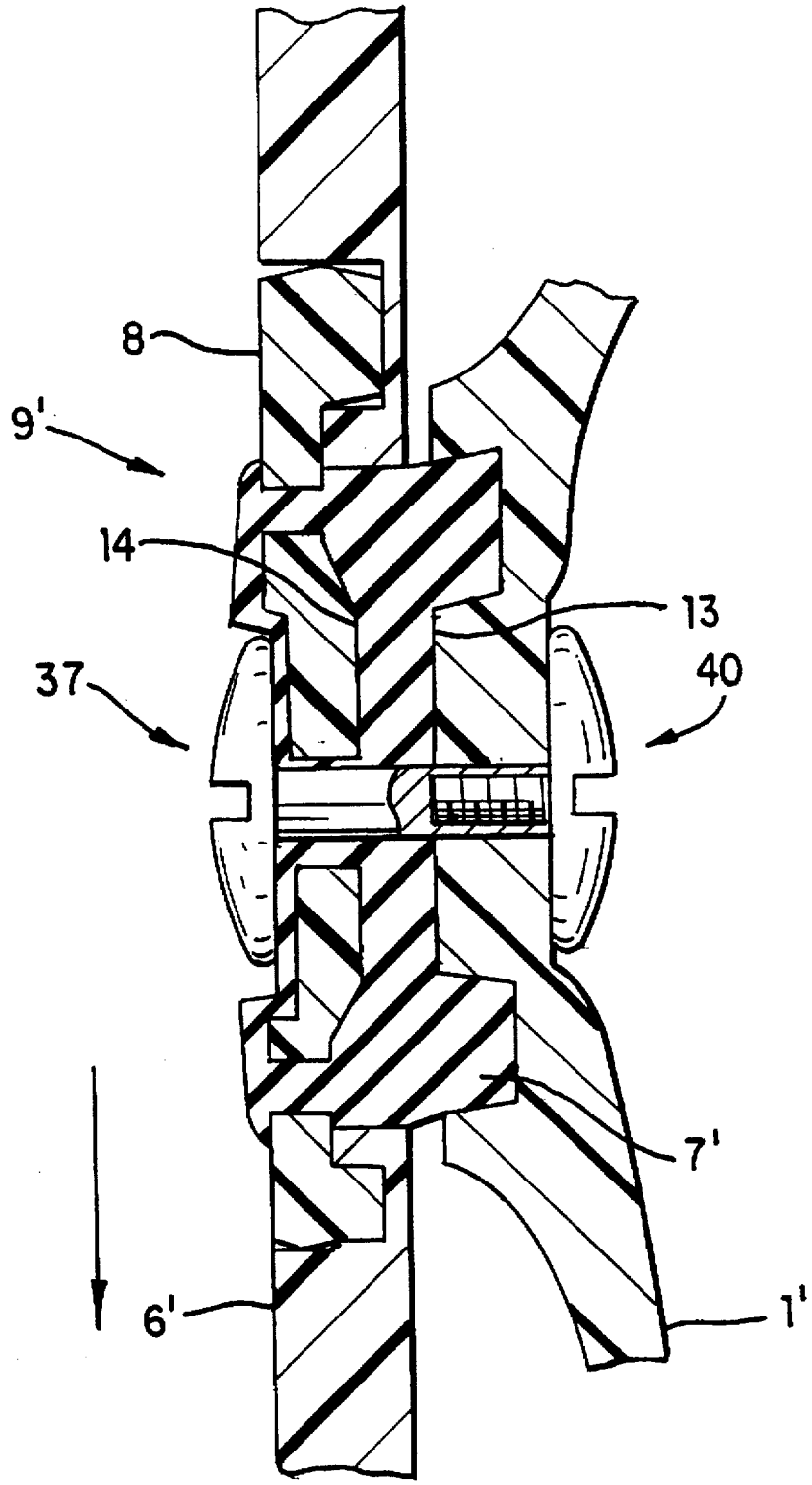

In FIG. 12, the cuff member has been pivoted forwardly with the top portion also being moved inwardly. This causes the elastomeric material to take the shape shown in FIG. 12 and thus accommodate the movement of the individual's leg.

Figure 13:
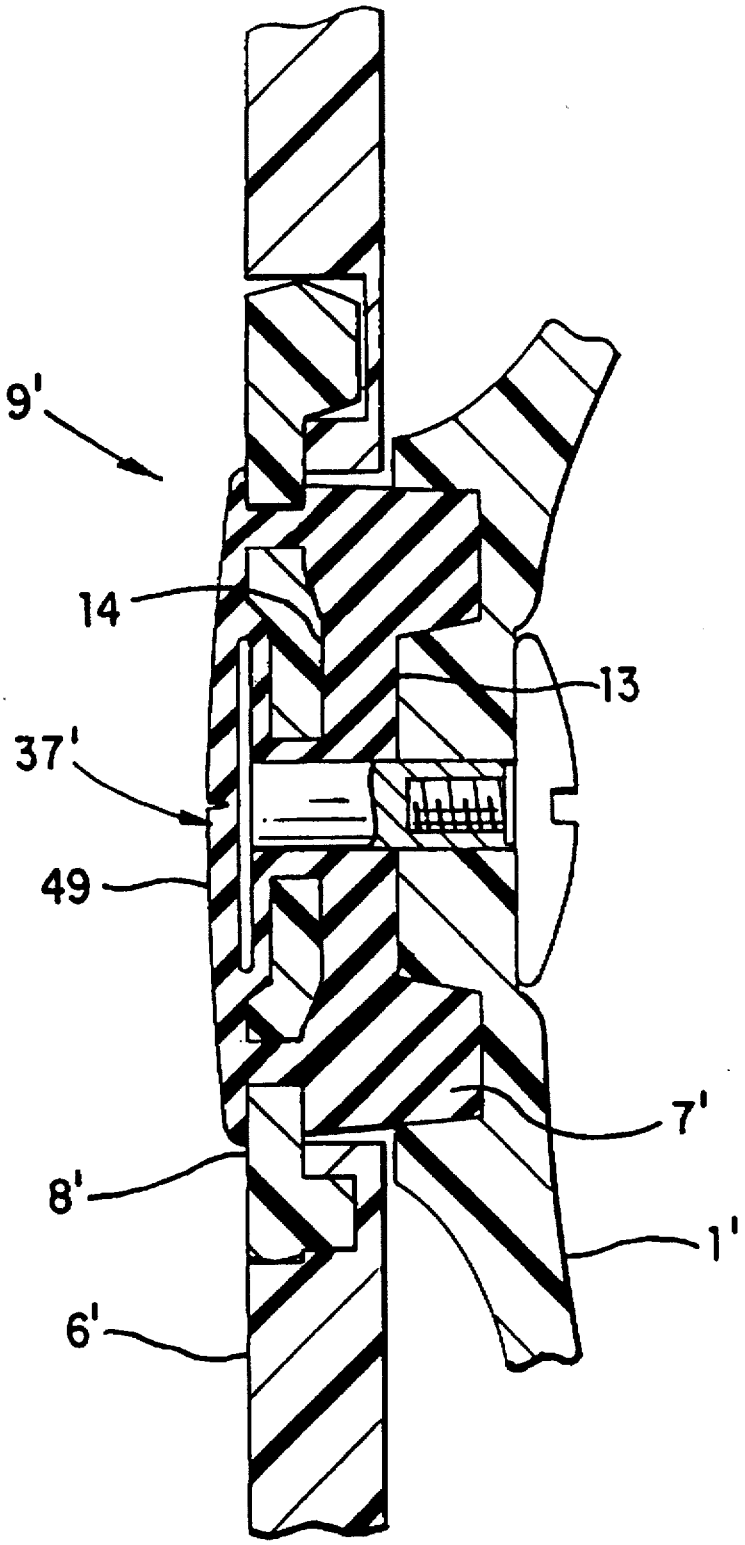

Another embodiment of the cuff insert unit 9' of the present invention is shown in FIG. 13, which is similar to the embodiment shown in FIG. 11, except that the first fastener or connector 37' has a flange 38', which is encompassed or covered by a layer of elastomeric material 49. The covering layer of elastomeric material 49 provides an aesthetic purpose as well as a location to place the logo of the boot manufacturer.

Figure 14:
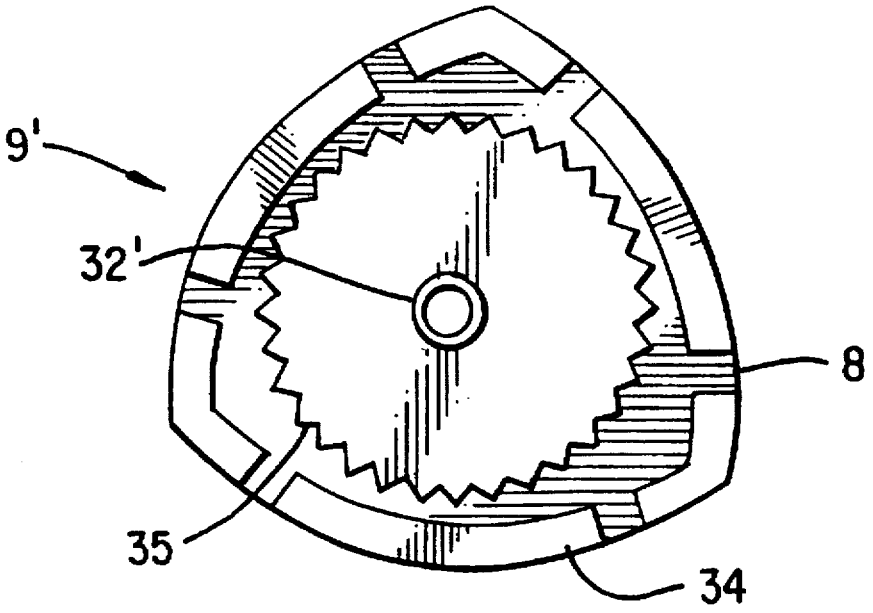
FIGS. 14–17 are plan and side views showing different embodiments of the cuff insert unit with the elastomeric material attached thereto.
Figure 15:
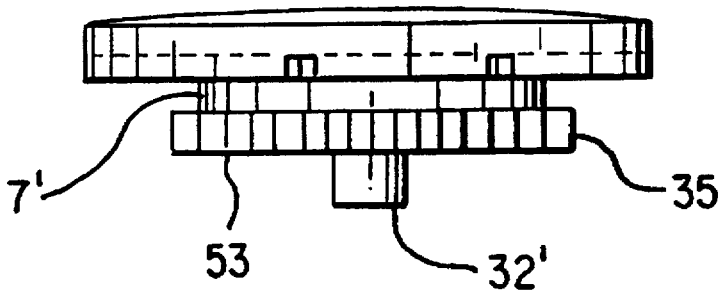
Figure 16:
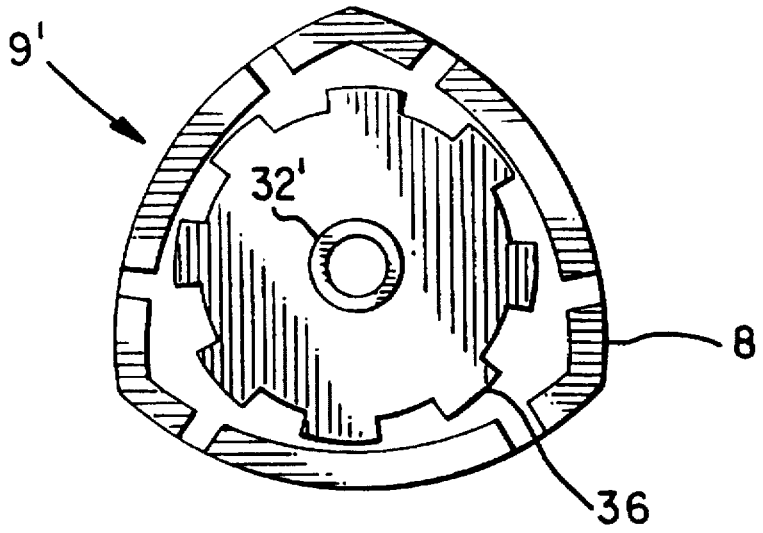
Figure 17:
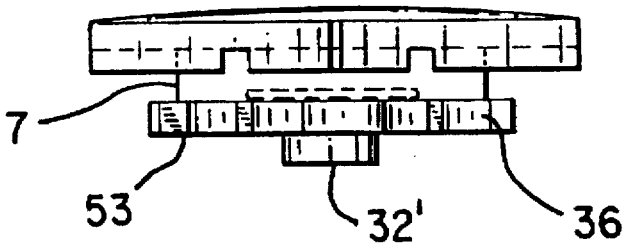

FIGS. 14–17 show other embodiments of the cuff insert unit 9' which are similar to the embodiments shown in FIGS. 8 and 10. The cuff insert unit 9' has a cuff member insert 8' with elastomeric material 7' extending therefrom. Each of the cuff member inserts 8' have a plurality of raised ridges 34 located around their peripheral edges. The cuff overlapping side sections 6' each has complementary recesses to accept the raised ridges 34 to provide an anti-rotation feature against the cuff member insert 8'. In FIGS. 14 and 15, the elastomeric material 7' has a plurality of radially extending teeth 35 at the outer peripheral edge of the elastomeric material. In FIGS. 16 and 17, the elastomeric material 7' has a plurality of radially extending lugs 36. With each of the embodiments shown, the shell member 1' has complementary recesses (not shown in FIGS. 14–17) to accept either the teeth 35 shown in FIG. 14, or the lugs 36 shown in FIG. 16 to connect the overlapping side sections 6' to the shell member 1'. The teeth 35 or the lugs 36 and the complementary shell lug recesses (not shown) prevent rotation of the elastomeric material first side 13 relative to the shell member 1'. With either of the embodiments shown in FIGS. 14 or 16, the teeth 35 or the lugs 36 could be located on a rigid inner plastic plate 53 bonded to the elastomeric material 7' with the teeth 35 or lugs 36 extending from the plate 53, similar to the embodiment shown in FIG. 10.

Figure 18:
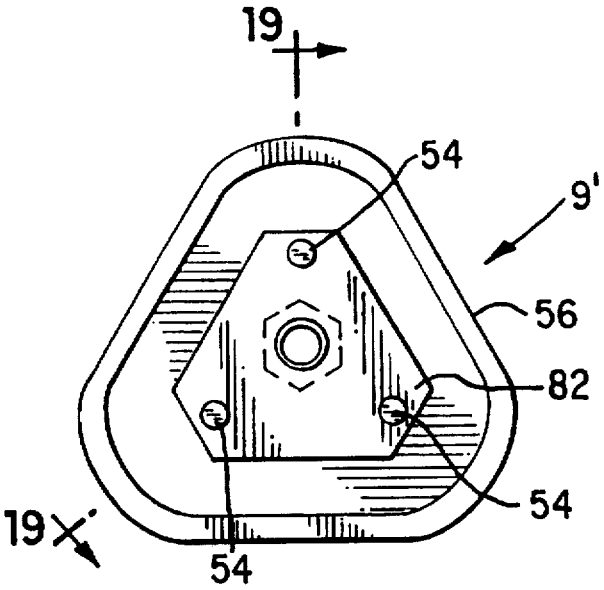
FIG. 18 is a plan view of an alternative embodiment of the cuff insert unit.
Figure 19:
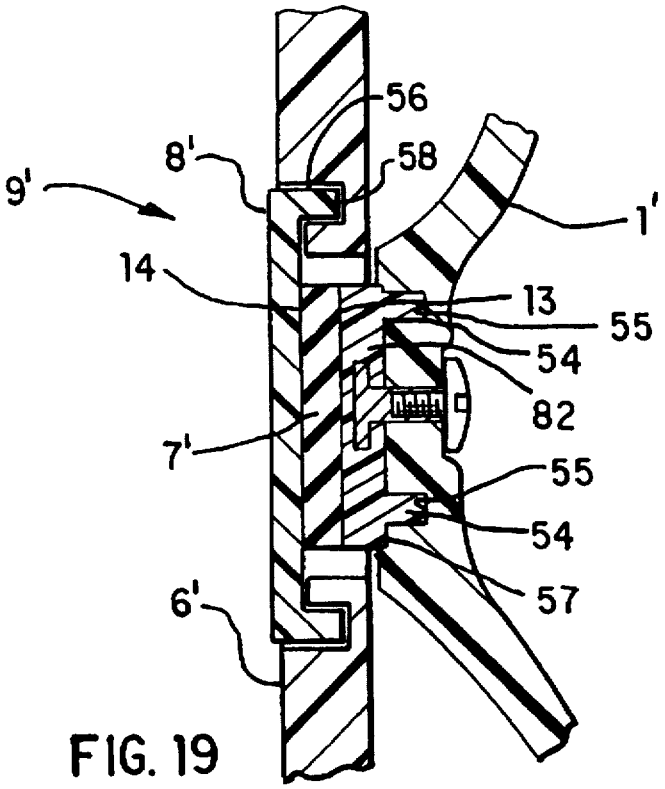
FIG. 19 is a partial cross-sectional view taken from line 19—19 of FIG. 18.
Figure 22:
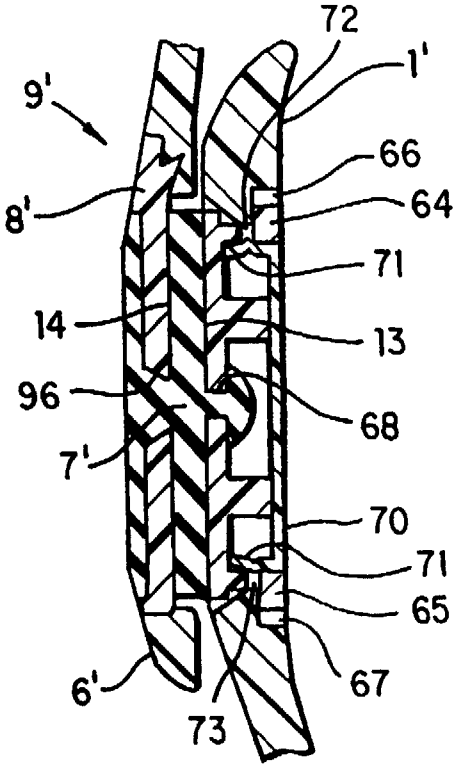
FIG. 22 is a partial cross-sectional view taken from line 22—22 of FIG. 21.

Yet another embodiment of the cuff insert unit 9' is shown in FIGS. 18 and 19. This embodiment is similar to the embodiment shown in FIG. 10 and would be particularly useful in a ski boot, wherein the forces on the cuff insert unit 9' would be much greater than in the case of an in-line skate. The cuff insert unit 9' has a rigid inner plate 82 with three lugs 54 extending from the plate 82 to interconnect with complementary lug recesses 55 in the shell 1'. The first side 13 of the elastomeric material is bonded to the internal side of the plate 82 and the second side 14 of the elastomeric material is bonded to the cuff insert 8'. A stiffening ridge 56 extends along the outer periphery of the cuff insert 8'. The plate 82 mates with a complementary plate recess 57. Likewise, the ridge 56 mates with a complementary cuff ridge recess 58.

Figure 20:
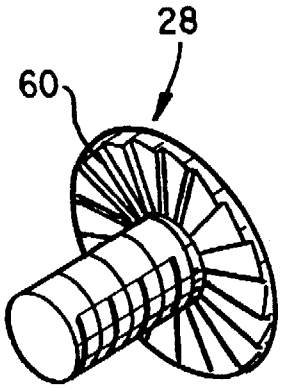
FIG. 20 is a perspective view of the bolt means used with the cuff insert unit.
Figure 21:
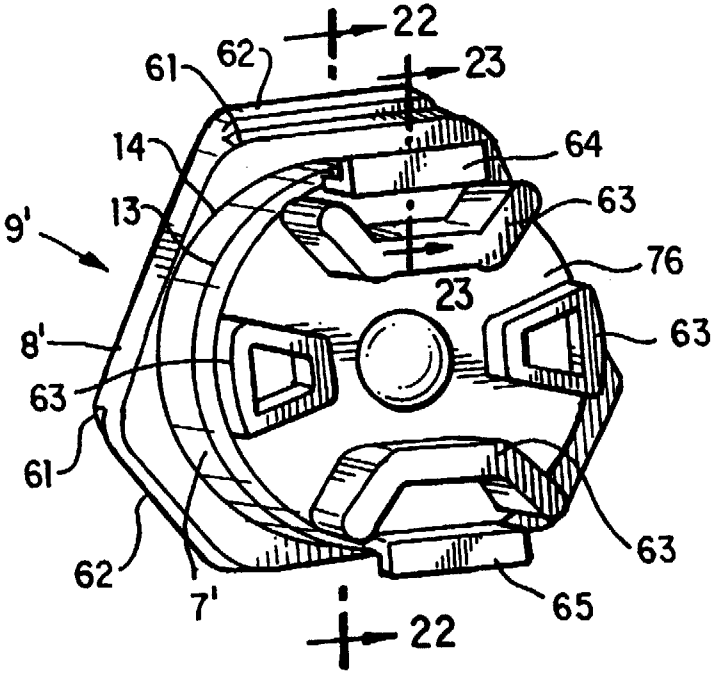
FIG. 21 is a perspective view of the cuff insert unit of an alternative embodiment wherein the cuff insert unit may be snapped into the respective parts of the boots.

As shown in FIG. 20, the fasteners or connectors used with the boot of the present invention that fasten the cuff insert unit to the boot, such as those shown in FIGS. 4–19 may have an anti-rotation feature, such as teeth 60 shown on the bolt 28. The teeth 60 are angled so as to prevent the backing out of the bolt.

Figure 23:
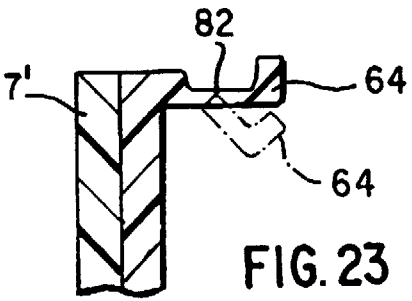
FIG. 23 is a partial cross-sectional view of the pivotable lug taken from line 23—23 of FIG. 21.

Another embodiment of the cuff insert unit is shown in FIGS. 21–27. The cuff member insert 8' has three ledges 61 on three separate and spaced apart outer peripheral surfaces 62 (only two shown). The ledges 61 have acute angles to provide a positive lock between the overlapping side section 6' and the cuff insert unit 9' when snapped into place. The cuff insert unit 9' also includes a plate 76. The first side of the elastomeric material 13 is bonded to the internal side of the plate 76 and the second side of the elastomeric material 14 is bonded to the cuff insert 8'. Extending from the external side of the plate 76 is a plurality of stationary lugs 63 as well as a first pivotable lug 64 and an opposite second pivotable lug 65. The plate 76 and the pivotable lugs 64 and 65 are made of the same injection or cast molded plastic material as the cuff insert 8', which is described in detail above. As shown in FIG. 23, the pivotable lugs have a notch 82 (only pivotable lug 64 shown), which thins the plastic material at the area where the pivotable lugs bend inward when compressive pressure is applied to the opposing pivotable lugs. In FIG. 23, the lug 64 is shown in the pivoted position with phantom lines. The notch 82 allows the pivotable lugs 64 and 65 to pivot, or deform inward when the cuff insert unit 9' is inserted into or removed from the shell 1'. The first pivotable lug 64 interconnects with a complementary first shell aperture 66 in the shell 1' and the second pivotable lug 65 interconnects with a complementary second shell aperture 67. The interconnection between the lugs 64 and 65 and the shell apertures 66 and 67 attach and lock the cuff insert unit 9' and the overlapping section 6' to the shell 1' to define a locked position relative to the cuff insert unit 9' and the shell member 1'.

In the embodiment of FIGS. 21–27, the opposite surfaces 13 and 14 of the elastomeric material 7' are bonded to the plate 76 and the cuff insert member insert 8 in the same way as in the previous embodiment described above. The plate 76 has a plate aperture 68 and the cuff member insert 8' has a cuff insert aperture 69. During the process of forming the elastomeric material 7' and bonding it to the surface of the cuff insert 8' and the plate 76, the elastomeric material 7' flows through the plate aperture 68 and the cuff insert aperture 69 to mechanically connect the cuff insert 8', the plate 76, and the elastomeric material 7' together as an assembly in the form of the cuff insert unit 9'.

Once the cuff insert unit 9' of FIGS. 21–27 is connected to the cuff 8' and shell 1', a lock bar 70 is positioned internally of the shell 1' to extend between the pivotable lugs 64 and 65. This positively locks the pivotable lugs 64 and 65 in the shell apertures 66 and 67 by obstructing their pivoting toward each other. The lock bar 70 has a two lock bar fingers 71. The lock bar fingers 71 lock into a first pivotable lug groove 72 and a second pivotable lug groove 73, respectively.

Figure 24:
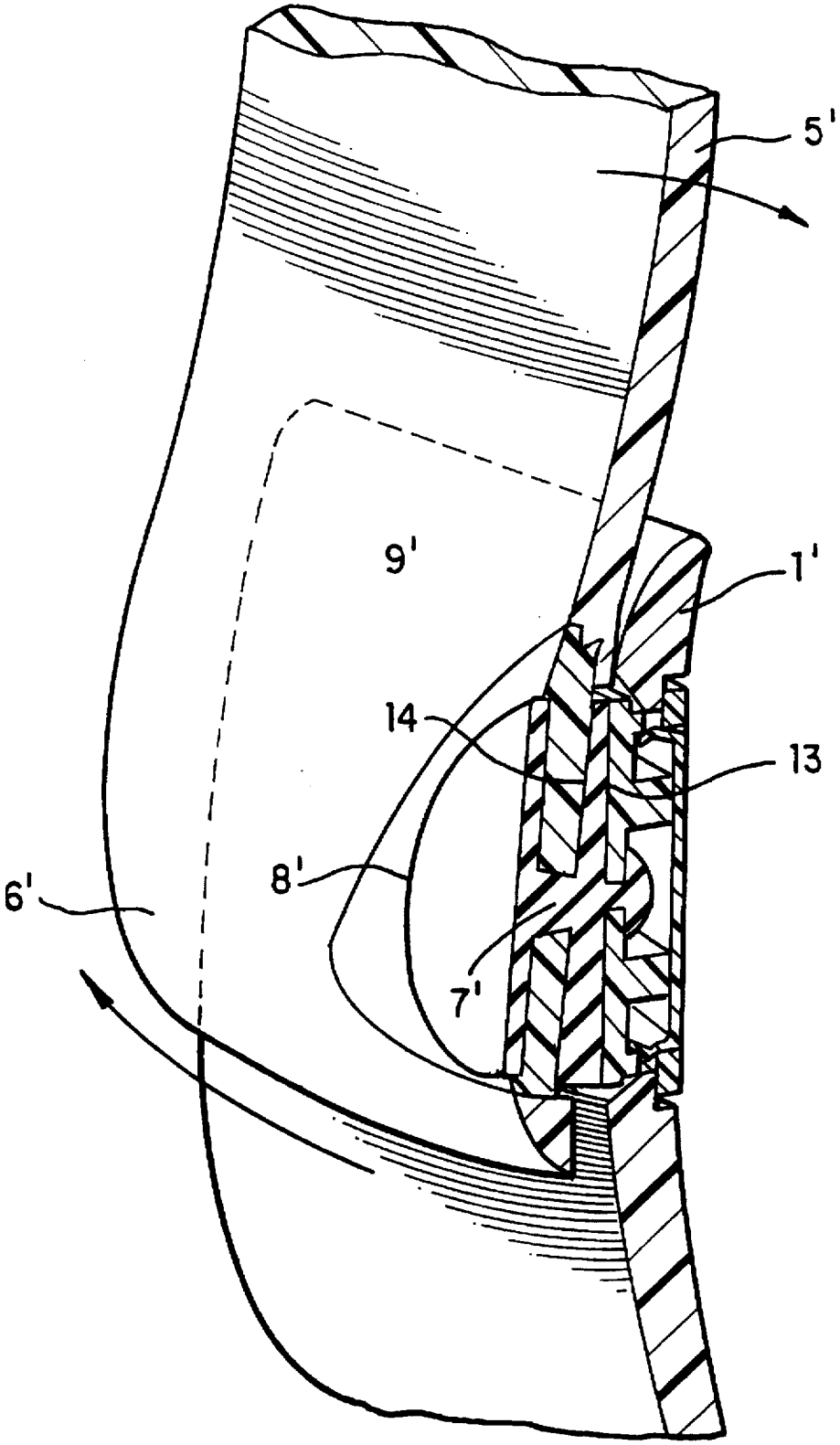
FIG. 24 is a partial perspective view of he alternative embodiment of FIG. 21 under stress.

FIG. 24 shows the embodiment of FIGS. 21–27 under stress. In FIG. 24, the cuff member 5' has been pivoted forwardly with the top portion also being moved inwardly. This causes the elastomeric material to take the shape shown in FIG. 24 and thus accommodate the movement of the individual's leg.

Figure 27:
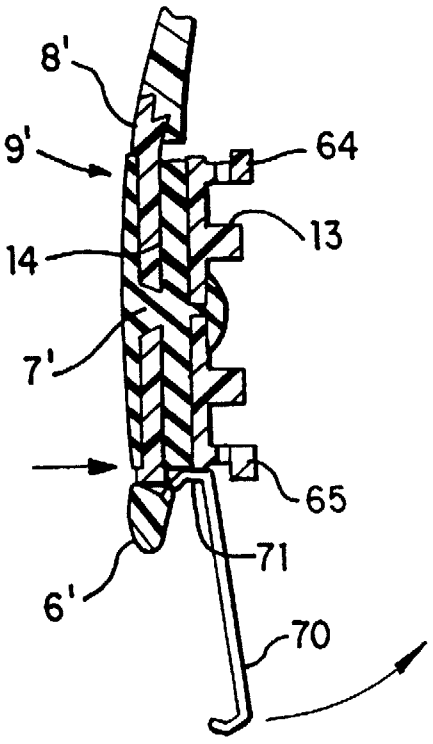
FIGS. 25–27 are partial cross-sectional views of the alternative embodiment of FIG. 21 showing the removal of the cuff insert unit from the cuff and shell members.
Figure 26:
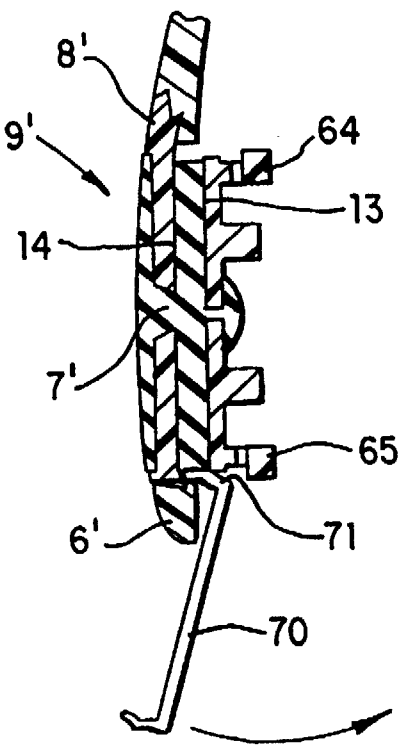
Figure 25:
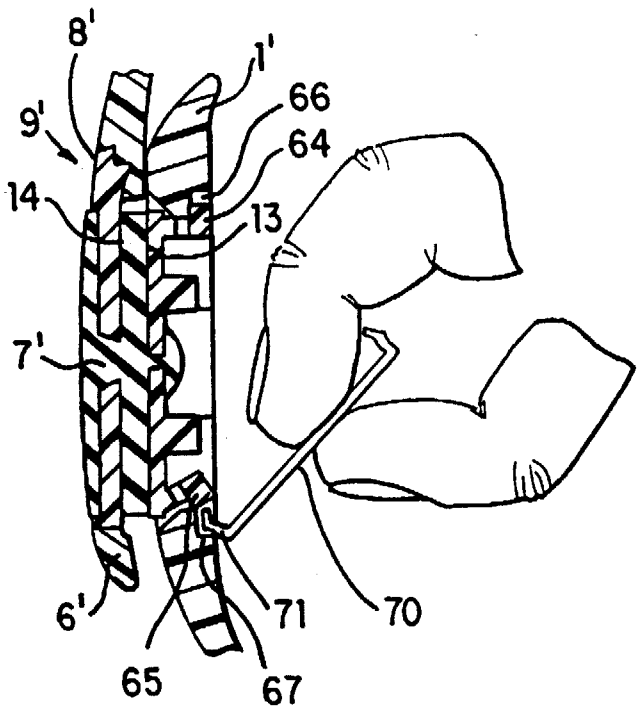

FIGS. 25–27 show the removal procedure for removing the cuff insert unit 9' from the shell 1' and the cuff overlapping section 6'. In FIG. 25, the lock bar 70 is shown removed from the cuff insert 9' and the shell 1' with the lock bar finger 71 shown prying the second pivotable lug 65 from the shell aperture 67. The lock bar finger 71 then is used to pry the first pivotable lug 64 from the shell aperture 66, which frees the cuff insert unit 9' from the shell 1'. FIGS. 26 and 27 show the cuff insert unit 9' free from the shell 1' with the lock bar 70 being used as a lever to pry the cuff insert unit 9' from the cuff overlapping section 6'. By applying pressure to the cuff insert 8' at one ledge 61 (not shown in FIG. 26) and at the exterior surface of the insert 8', that particular ledge 61 becomes separated from the cuff overlapping section 6'. The process is repeated until the cuff insert unit 9' is removed from the cuff overlapping section 6'.

The cuff insert unit 9' is reattached to the cuff overlapping section 6' and the shell 1' by snapping the cuff insert unit 9' into the cuff overlapping section 6' at the ledges 61. Then the pivotable lugs 64 and 65 are snapped into the shell apertures 66 and 67 to attach the cuff insert unit 9' to the shell 1'.

Figure 28:
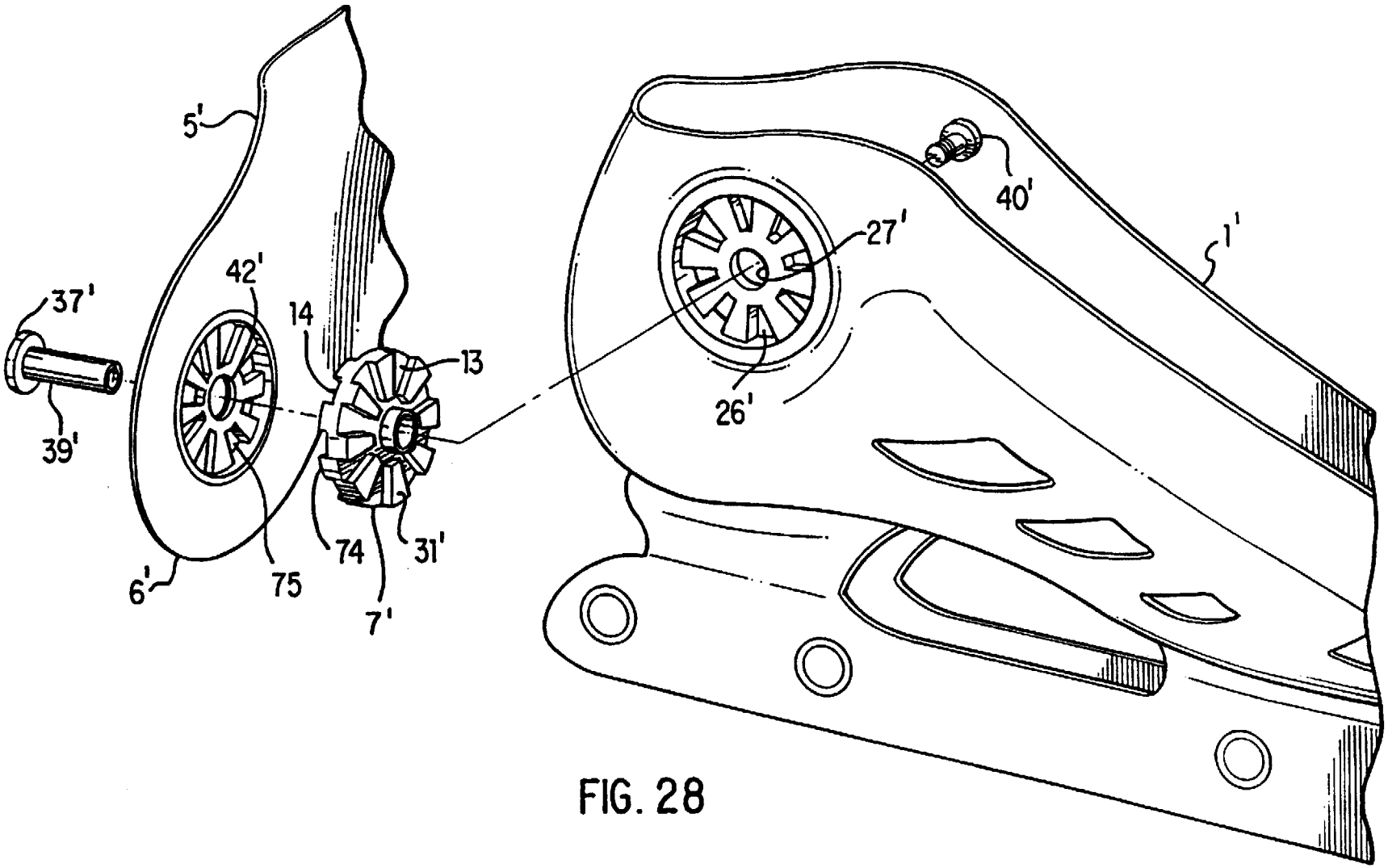
FIG. 28 is an exploded cross-sectional view showing an alternative embodiment of present invention.
Figure 30:
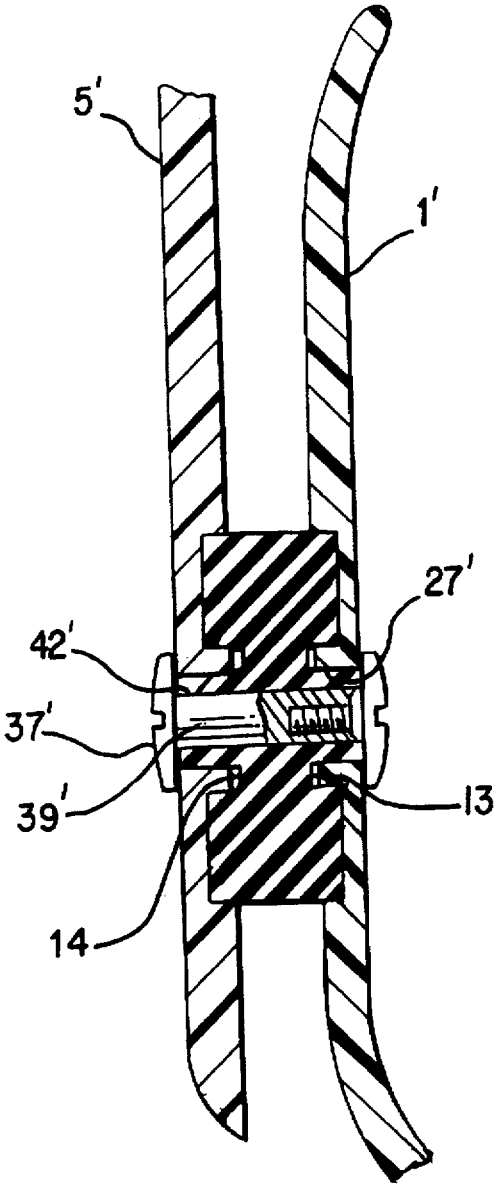
FIG. 29–30 are partial cross-sectional views of the embodiment shown in FIG. 28.
Figure 29:
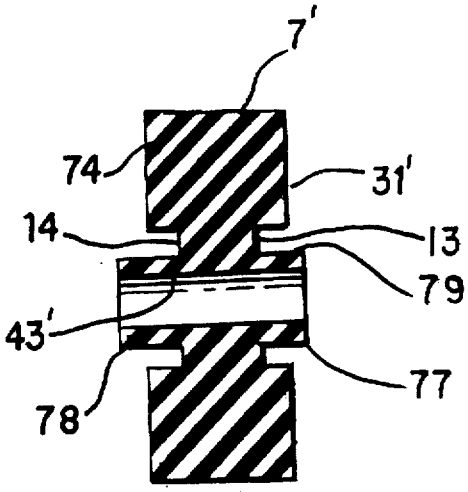

Another embodiment of the present invention is shown in FIGS. 28–30. This embodiment is similar to the embodiment shown in FIG. 11, except that the elastomeric material 7' has lugs 31' extending from the first side 13 and has lugs 74 extending from the second side 14. The interior lugs 31' mate with complementary shell lug recesses 26 and the exterior lugs 74 mate with complementary cuff lug recesses 75. The lugs 31' and 74 are mechanically connected to the lug recesses 26' and 75 by a fastening means, or connector 37' and 40'. The shell aperture 27' and the cuff aperture 42' are approximately one and one half times larger in diameter in relation to the outside diameter of the stud portion 39' of the connector 37', defining a stud clearance gap.

As shown in FIG. 29, the elastomeric material 7' has an elastomeric shell extension 77 and an elastomeric cuff extension 78. The elastomeric extensions 77 and 78 are cylindrical in shape and have an outside diameter 79 that allow the extensions 77 and 78 to extend into the shell aperture 27' and the cuff aperture 42', respectively, and to fill the stud clearance gap. The sizing of the apertures 27' and 42' and the complementary extensions 77 and 78 cooperate with the stud 39' to provide a floating pivot axis when assembled.

Figure 31:
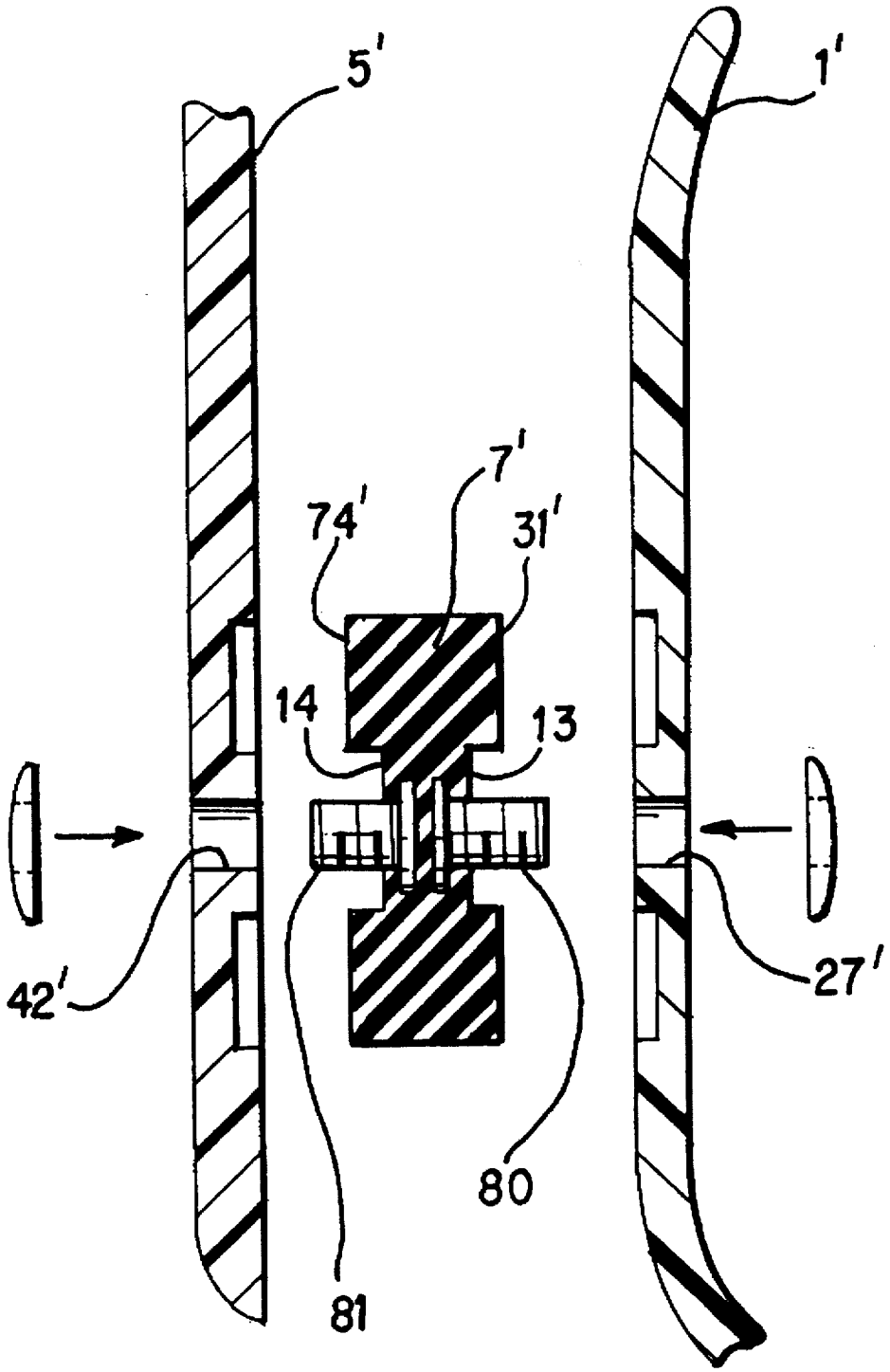
FIG. 31 is an exploded cross-sectional view showing an alternative embodiment of the present invention.
Figure 32:
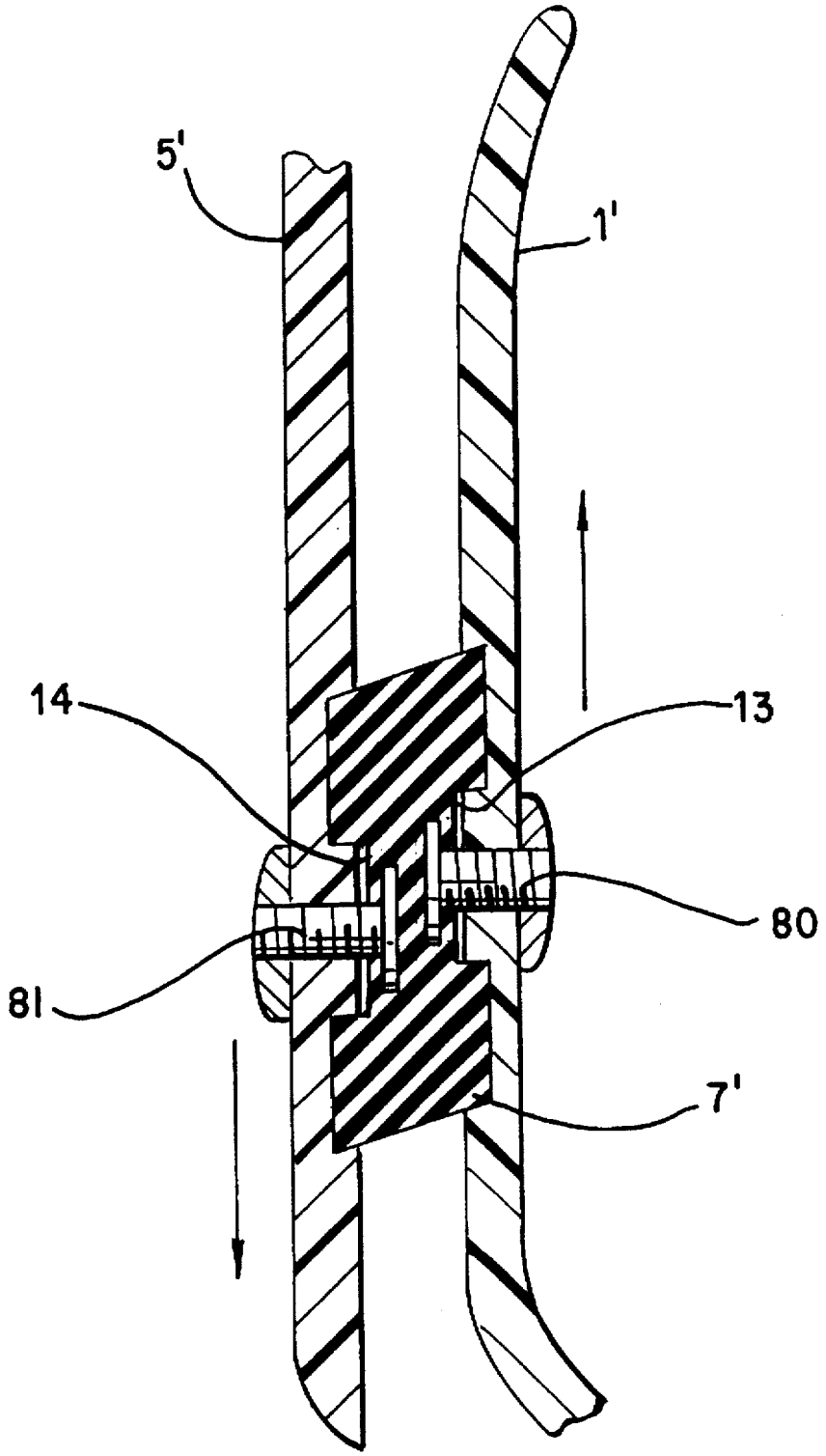
FIG. 32 is a partial cross-sectional view of the alternative embodiment of FIG. 31 under stress.

Finally, another embodiment is shown in FIGS. 31–32. The embodiment is similar to the embodiment shown in FIGS. 28–30, except that the fastening means includes a first T-bolt 80 embedded in and extending from the first side 13 of the elastomeric material 7' and includes a second T-bolt 81 embedded in and extending from the second side 14 of the elastomeric material 7'. As shown in FIG. 32, the independent T-bolts 80 and 81 provide a floating pivot axis when the boot experiences shear and torsional stresses.

We claim:

1. The improvement in a boot having a first shoe shaped shell member with a heel, middle and front portion for receiving and supporting an individual's foot along at least the bottom portion of the foot, a second member having a section overlapping the shell member with a first surface of said second member facing a first surface of said shell member, said second member extending upwardly from the shell member for covering a portion of the individual's leg; and attaching means for pivotally attaching the second member to the shell member for rotation about a pivot axis; the improvement wherein said attaching means includes:

a) an insert with a first surface facing said first surface of said shell member, said insert removably connected to said section of the second member overlapping the shell member and pivotally connected to the shell member for pivoting movement of said second member relative to said shell member in response to pivoting of the individual's leg relative to the individual's foot;

b) an elastomeric material disposed between said shell member and said insert, said elastomeric material having opposite sides, with a first side facing said first surface of the shell member and a second side facing said first surface of the insert;

c) a connecting means for connecting said first side of said elastomeric material to said shell member and said second side thereof to said insert for movement of said first and second sides of the elastomeric material relative to each other in a direction extending along said surfaces of said shell member and said second member as said second member is pivoted relative to said shell member.

2. The boot according to claim 1 wherein:

a) the elastomeric material is shaped with an outer lateral periphery of predetermined shape and a thickness, as measured between said first and second sides which is a fraction of the distance laterally across either of said first and second sides.

3. The boot according to claim 1 wherein:

a) said elastomeric material includes physical characteristics permitting said first and second sides thereof to rotate and shift laterally at the same time with respect to each other during pivoting of said second member relative to said shell member and said first and second sides of said elastomeric material are connected, respectively, to the surfaces of said shell member and insert so as to define a floating pivot axis for said pivoting.

4. The boot according to claim 3 wherein:

a) said first side of said elastomeric material is mechanically connected to said shell member; and b) said second side of said elastomeric material is bonded to said insert.

5. The boot according to claim 4 wherein:

a) the second member is a cuff member which includes an overlapping section on either side of the shell member with the insert being in the area of the ankle bone of the individual's leg;

b) said insert and elastomeric material define a cuff insert unit; and c) said cuff insert unit is removably connected to said cuff member and to said shell member at each of said overlapping sections.

6. The boot according to claim 5 wherein:

a) said shell member includes a recess in said surface thereof; and b) said elastomeric material extends into said recess to connect said elastomeric material to said shell member.

7. The boot according to claim 5 wherein:

a) said cuff insert unit further includes a plate bonded to said first side of said elastomeric material; and b) said plate is removably connected to said shell member.

8. The boot according to claim 7 wherein:

a) said plate further comprises at least two lugs, said two lugs have pivotable locking means to lock with said shell member and to define a locked position relative to said shell member.

9. The boot according to claim 8 wherein:

a) said shell member has complementary lug apertures to accept said pivotable lugs; and b) a removable lock bar is connected between said lugs to maintain the lugs in the locked position.

10. The boot according to claim 5 wherein:

a) said cuff member has a second surface opposite of said first surface of said cuff member;

b) said cuff member second surface has a recess complementary to an outer peripheral surface of said insert; and c) said insert fits into said cuff member second surface recess.

11. The boot according to claim 10 wherein:

a) said cuff member recess and said insert each have a complementary triangular or wankel configuration to prevent relative rotation about said pivot axis.

12. The boot according to claim 10 wherein:

a) said insert has at least two posts that extend toward said cuff member recess; and b) said cuff member recess has an equal number of complementary post recesses accommodating said insert posts.

13. The boot according to claim 12 wherein:

a) one of said insert posts and the corresponding complementary post recess are larger than other said insert post and post recess.

14. The boot according to claim 5 wherein:

a) said elastomeric material further has a plurality of lugs extending from said first side of said elastomeric material towards said first surface of said shell member; and b) said shell member has a plurality of complementary recesses to accept said lugs extending from said first side of said elastomeric material.

15. The boot according to claim 3 wherein:

a) said elastomeric material further has a plurality of lugs extending from said first side of said elastomeric material towards said first surface of said shell member;

b) said elastomeric material further has a plurality of lugs extending from said second side of said elastomeric material towards said first surface of said cuff member;

c) said shell member has a plurality of complementary recesses to accept said lugs extending from said first side of said elastomeric material; and d) said cuff member has a plurality of complementary recesses to accept said lugs extending from said second side of said elastomeric material.

16. The boot according to claim 5 wherein:

a) said connecting means further comprises a connector extending from said elastomeric material and connected between said shell member and said cuff member for restricting axial movement of said elastomeric material relative to said cuff member and said shell member.

17. The boot according to claim 5 wherein:

a) said connecting means further comprises a connector at least partially embedded in said elastomeric material and extends towards said first surface of said shell member.

18. The boot according to claim 17 wherein:

a) said shell member includes an aperture extending from said first surface to an opposite second surface thereof; and b) said connector includes:

i) a threaded stud at least partially embedded in said elastomeric material and extending through said aperture in said shell member; and ii) a nut threaded onto said stud at said opposite second surface of said shell member to hold said cuff insert unit against axial movement relative to said shell member.

19. The boot according to claim 17 wherein:

a) said connector comprises a bolt having a bolt axis extending between a first end and a second end of said bolt, said first end extending towards said first surface of said shell member and said second end having a flange embedded in said elastomeric material.

20. The boot according to claim 19 wherein:

a) said flange is embedded in said elastomeric material against rotation about said bolt axis.

21. The boot according to claim 5 wherein:

a) said shell member includes an aperture extending from said first surface to an opposite second surface thereof;

b) said cuff insert unit includes an aperture extending from said first side of said elastomeric material to an opposite cuff insert unit second side, said shell member aperture and said cuff insert unit aperture are axially aligned relative to each other; and c) said connecting means further comprises a connector extending through said cuff insert unit aperture and said shell member aperture for restricting axial movement of said elastomeric material relative to said cuff member and said shell member.

22. The boot according to claim 21 wherein:

a) said connector further comprises a stud extending through said cuff insert unit and said shell member; and b) one of said cuff insert unit aperture or said shell member aperture is larger than said stud to define a stud clearance gap.

23. The boot according to claim 22 wherein:

a) said elastomeric material is located in said stud clearance gap.

24. The boot according to claim 23 wherein:

a) said larger aperture is approximately one and one half times larger than said stud.

25. The boot according to claim 23 wherein:

a) said connector comprises a bolt having a bolt axis extending between a first end and a second end of said bolt, said first end extending towards said first surface of said shell member and said second end having a flange facing said cuff insert unit second side; and b) said elastomeric material is located between said flange and said cuff insert unit second side.

26. The boot according to claim 5 wherein:

a) the elastomeric material is a mixture of an isocyanate terminated urethane prepolymer and an aliphatic poyol blend.

27. The boot according to claim 5 wherein:

a) the elastomeric material is a polyester polyurethane.

28. The boot according to claim 5 wherein:

a) the elastomeric material is a mixture of an isocyanate terminated urethane prepolymer and a high molecular weight polytetra-methylene ether glycol mixed with a tri-functional curative.

29. The boot according to claim 28 wherein:

a) the prepolymer is diphenylmethane di isocyanate and a high molecular weight polytetra-methylene ether glycol.

30. The boot according to claim 5 wherein the elastomeric material has the following physical characteristics:

| | |
|---|---|
| durometer | 50–90 Shore A |
| Bayshore rebound | 30–85% |
| split tear | 15–200 psi. |
| 100% modulus | 50–1000 psi. |
| 300% modulus | 100–3000 psi. |
| 500% modulus | 150–5000 psi. |
| tensile | 1000–5500 psi. |
| elongation | 200–800% |
| compression set | 1–50%. |

31. The boot according to claim 30 wherein the preferred elastomeric material has the following physical characteristics:

| | |
|---|---|
| durometer | 77 Shore A |
| Bayshore rebound | 75% |
| split tear | 45 psi. |
| 100% modulus | 192 psi. |
| 300% modulus | 224 psi. |
| 500% modulus | 256 psi. |
| ultimate tensile | 1280 psi. |
| ultimate elongation | 750% |
| compression set | 30%. |

* * * * *